US007605540B2

(12) United States Patent
Okazaki et al.

(10) Patent No.: US 7,605,540 B2
(45) Date of Patent: Oct. 20, 2009

(54) PLASMA DISPLAY PANELS AND PLASMA DISPLAY DEVICES WHICH USE THE PANEL

(75) Inventors: Choichiro Okazaki, Kodaira (JP); Masatoshi Shiiki, Musasimurayama (JP); Keizo Suzuki, Kodaira (JP); Kenichi Yamamoto, Higashimurayama (JP)

(73) Assignee: Hitachi, Ltd., Tokyo (JP)

( * ) Notice: Subject to any disclaimer, the term of this patent is extended or adjusted under 35 U.S.C. 154(b) by 475 days.

(21) Appl. No.: 11/062,852

(22) Filed: Feb. 23, 2005

(65) Prior Publication Data

US 2005/0236987 A1 Oct. 27, 2005

(30) Foreign Application Priority Data

Apr. 27, 2004 (JP) ..... 2004-131465

(51) Int. Cl.
*H01J 17/49* (2006.01)

(52) U.S. Cl. ..... 313/587; 313/586; 313/582

(58) Field of Classification Search ..... 313/582–587
See application file for complete search history.

(56) References Cited

U.S. PATENT DOCUMENTS

| | | | | |
|---|---|---|---|---|
| 6,750,610 | B2 | 6/2004 | Bechtel et al. | |
| 2002/0084751 | A1 | 7/2002 | Kim | |
| 2002/0167275 | A1 | 11/2002 | Bechtel et al. | |
| 2003/0011307 | A1* | 1/2003 | Otani et al. | 313/582 |

FOREIGN PATENT DOCUMENTS

| | | | |
|---|---|---|---|
| EP | 1376643 | | 5/2003 |
| JP | 2-242548 | | 9/1990 |
| JP | 8-227664 | | 9/1996 |
| JP | 11-260269 | | 9/1999 |
| JP | 2000-242186 | | 9/2000 |
| JP | 2001-215886 | | 8/2001 |
| JP | 2002075214 | A * | 3/2002 |
| JP | 2003/203570 | | 7/2003 |
| JP | 2004-031287 | | 1/2004 |
| JP | 2004/508664 | | 3/2004 |
| WO | WO 02/19370 | A1 | 3/2002 |

OTHER PUBLICATIONS

"UP-to-date Technology for Plasma Displays" by Shigeo Mikoshiba.
SID 93 Digest 14.4: "A 640×480 High-Resolution Color ac Plasma Display" by G. Baret, et al.

* cited by examiner

*Primary Examiner*—Nimeshkumar D. Patel
*Assistant Examiner*—Anthony T Perry
(74) *Attorney, Agent, or Firm*—Mattingly & Malur, P.C.

(57) ABSTRACT

A plasma display panel has plurality discharge cells disposed between a pair of opposing first and second substrates. Each of the discharge cells includes at least: at least one pair of electrodes for generating a discharge for display; a discharge gas; and a phosphor film for emitting visible light by being excited by ultraviolet light produced by the discharge of the discharge gas. Laminated members are dispersed in a plane within each of the discharge cells inside the first substrate from which visible light for display is emitted. Each of the laminated members includes a light absorption layer disposed on a side of the first substrate on which ambient light is incident and a light reflection layer disposed on a phosphor-film side of each of the laminated members.

20 Claims, 18 Drawing Sheets

PLASMA DISPLAY PANELS AND PLASMA DISPLAY DEVICES WHICH USE THE PANEL

CLAIM OF PRIORITY

The present application claims priority from Japanese application serial no. 2004-131465, filed on Apr. 27, 2004, the content of which is hereby incorporated by reference into this application.

BACKGROUND OF THE INVENTION

1. Field of the Invention

The present invention relates to a plasma display panel (hereinafter also referred to as a PDP) used for a flat-type TV set and others and a plasma display device employing the plasma display panel, and in particular to a structure of a plasma display panel capable of realizing the improvement of its display brightness and display contrast.

2. Description of Prior Art

The plasma display panel is used in a large-screen, small-depth, flat-screen TV set, and has improved in performance. However, its light-room display contrast, that is, a contrast as measured in a well-lighted environment (usually assumed to be a living room provided with an ambient room illumination producing 150-200 l×), is not satisfactory yet.

FIG. 2 is an exploded perspective view of part of a structure of an example of a typical plasma display panel. The plasma display panel has a structure in which front and rear substrates are attached together and a discharge gas is filled therebetween.

The front substrate includes a plurality of electrode pairs each comprised of a transparent electrode 2 and a bus electrode 3 for producing a sustain discharge (also called a display discharge) disposed on a front glass plate 1 (usually, one electrode of the electrode pair is called an X electrode, and the other electrode of the electrode pair is called a Y electrode. In FIG. 2, only one pair of the plural electrode pairs is shown. The electrode pairs are covered with a dielectric 4 and a protective film 5.

The rear substrate includes address electrodes 9 disposed on a rear glass plate 6, and the address electrodes 9 are covered with a dielectric 8. Barrier ribs 7 are disposed on the dielectric 8, and red, blue and green phosphor films 10 are disposed between the barrier ribs 7, respectively.

The front and rear substrates are aligned with each other and are sealed together such that the electrodes on the front substrate intersect those on the rear substrate at approximately right angles (in some cases, such that the electrodes on the front substrate intersect those on the rear substrate at angles other than the approximately right angles). A space between the two substrates is filled with a discharge gas, and thereby a plurality of cells are formed. A discharge is created in a desired one of the plurality of cells, by selectively applying appropriate voltages to the sustain electrode pairs on the front substrate and the address electrodes on the rear substrate. By this main discharge, vacuum ultraviolet light is produced, emission of red, blue and green lights is generated from the respective ones of the red, blue and green phosphor films 10 excited by the produced vacuum ultraviolet light, thereby producing a full-color display.

However, since the body color of the phosphor 10 is usually close to white, ambient light incident on the plasma display panel is reflected by the phosphor film 10, and degrades the display contrast.

Japanese Patent Application Laid-Open No. 2004-31287 Publication discloses a method of improving display contrast which realizes higher display contrast by suppressing degradation of display brightness using a striped laminated member composed of a light absorption layer and a light reflection layer. FIG. 3 is a front view of a plasma display panel of an example disclosed in this publication, and FIG. 4 is a cross-sectional view of the plasma display panel of FIG. 3 taken along line IV-IV' of FIG. 3. The laminated member 130 is composed of a light absorption layer 110 and a light reflection layer 120, and ambient light incident on the plasma display panel is absorbed by the light absorption layer 110. On the other hand, light which is incident onto the light reflection layer 120 from a phosphor film 10 is reflected back toward the phosphor film 10, then is reflected again by the phosphor film 10, and then is emitted into the outside of the plasma display panel.

FIG. 5 illustrates a phenomenon which happens in a case where an aperture ratio of a discharge cell is reduced so as to realize a higher display contrast ratio by using the above conventional technique. Light from the phosphor film 10 at the peripheral portions of one discharge cell undergoes multiple reflections between the phosphor film 10 and the light reflection layers 120. If light reflections on the surface of one of or the surfaces of both the phosphor film 10 and the light reflection layers 120 are diffuse reflections, the number of the multiple reflections increases even more. In this case, since the reflectance of the phosphor film 10 and the light reflection layers 120 is less than 100%, no small amount of the light is absorbed. Consequently, the intensity of the light emitted from the plasma display panel is reduced as the number of light reflections is increased within the discharge cells. Therefore, as the aperture ratio is reduced for the purpose of improving the display contrast in the above conventional technique, the display brightness is reduced.

Although the device has been described in connection with the so-called ac surface-discharge three-electrode type PDP, it is needless to say that the present invention is applicable to various types of PDPs. For example, the present invention is applicable to dc-type PDPs as disclosed in Mikoshiba, S: "Up-to-date Technology for Plasma Displays," chap. 6, ED Research Company, Tokyo, 1996, and is also applicable to vertical-discharge type PDPs as disclosed in G. Baret, et al.: 14.4: A 640×480 High-Resolution Color ac Plasma Display, SID 93 DIGEST, pp. 173-175.

In connection with the PDP of the above-explained structure, a full-color display has been explained as formed by exciting the respective primary-color phosphors to emit red, blue and green light with vacuum ultraviolet light produced by the main discharge. However, needless to say, the present invention is not only applicable in a case where the phosphors are excited by vacuum ultraviolet light, but is also applicable in a case where the phosphors are excited by ultraviolet light other than the vacuum ultraviolet light. Further, needless to say, while the PDP of the above-explained structure generates visible lights of red, blue and green by using the phosphors, the present invention is also applicable to PDPs of a structure capable of generating visible lights directly by discharges. Further, needless to say, the present invention is also applicable in a case where visible lights of colors other than red, blue and green are generated, and in a case where a visible light of a single color is generated.

SUMMARY OF THE INVENTION

It is an object of the present invention to improve display contrast of a plasma display panel and to suppress degradation in display brightness at the same time.

The following will explain the summary of the representative ones of the inventions disclosed in this specification.

(1) A plasma display panel comprising a plurality of discharge cells disposed between a pair of opposing first and second substrates, each of said plurality of discharge cells comprising at least: at least one pair of electrodes for generating a discharge for display; a discharge gas; and a phosphor film for emitting visible light by being excited by ultraviolet light produced by said discharge of said discharge gas; wherein laminated members are dispersed in a plane within each of said plurality of discharge cells inside said first substrate from which visible light for display is emitted, and each of said laminated members comprises a light absorption layer disposed on a side of said first substrate on which ambient light is incident and a light reflection layer disposed on a phosphor-film side of said each of said laminated members.

(2) A plasma display panel according to (1), wherein said laminated members are integrally fabricated to form a unitary structure in said plane within each of said plurality of discharge cells and said unitary structure perforated with plural openings passing light therethrough in said plane.

(3) A plasma display panel according to (1), wherein said laminated members are plural in number within each of said discharge cells, and are disposed separately from each other in said plane.

(4) A plasma display panel according to (1), wherein said laminated members are plural in number within each of said discharge cells, and are disposed separately two-dimensionally from each other in said plane.

(5) A plasma display panel according to (1), wherein an aperture ratio (S1−S2)/S1 satisfies the following inequality: $0.1 \leqq (S1-S2)/S1 \leqq 0.8$, where S1 is an area of an opening of one of said discharge cells for emitting said visible light therethrough projected onto said first substrate, and S2 is a sum of areas occupied by said light absorption layers within said area S1.

(6) A plasma display panel according to (2), wherein said laminated members are fabricated in a pattern of one of a mesh and a ladder.

(7) A plasma display panel according to (2), wherein said laminated members are provided with openings in a pattern of branches of a tree.

(8) A plasma display panel according to (3), wherein said laminated members are formed in a pattern of one of (i) isolated islands and (ii) branches of a tree.

(9) A plasma display panel according to (1), wherein said plasma display panel has at least one cross-section which satisfies the following inequality: $0<La/L \leqq 0.5$, where, consider a cross section containing a line contained in a plane of said first substrate and perpendicular to said plane of said first substrate, L is a length of one of said discharge cells as measured in a direction of said line, and La is a minimum value of a length of said laminated members as measured in said direction of said line.

(10) A plasma display device including at least a plasma display panel and a driving circuit which applies voltages to said plasma display panel, wherein said plasma display panel comprises a front substrate through which visible light for display is emitted and a plurality of discharge cells; each of said plurality of discharge cells is provided at least with electrodes for applying voltages to said each of said discharge cells, a discharge gas for generating discharge, a substance which generates visible light based upon said discharge, and laminated members each comprised at least of a light absorption layer and a light reflection layer; and said front substrate defines a part of a discharge space which generates said discharge and forms part of a hermetic sealing, wherein a visual field space is defined as a space on a side of said front substrate opposite from said discharge space, a display surface is defined as a surface obtained by expanding over an entire area of each of said plurality of discharge cells a surface of said front substrate in contact with said discharge space, a portion of said visible light emitted into said visual field space through said display surface serves as said visible light for display, wherein a BM height hd is defined as an average of distances between a bottom surface of said discharge space and discharge-space-side surfaces of said laminated members, as measured perpendicularly to said display surface, where a first plane containing said laminated members is considered, and said bottom surface of said discharge space is a plane which faces said first plane across said discharge space and which bounds said discharge space, wherein said laminated members are disposed one of (i) within said discharge space, (ii) between said discharge space and said front substrate, and (iii) within said front substrate, are each comprised of a light absorption layer disposed on a visual-field-space side thereof and a light reflection layer disposed on a discharge-space side thereof, wherein the following inequality is satisfied: $Lave/hd<5$, where a BM region is defined as a region occupied by said laminated members in said display surface, a light-transmissive region is defined as a region in said display surface through which said visible light from said discharge space is emitted into said visual field space, a length dbm-A is defined as a shortest distance between an arbitrary point A in said BM region and said light-transmissive region, and Lave is a value of said length dbm-A averaged over an entire area of said BM region with respect to said arbitrary point A.

(11) A plasma display device according to (10), wherein said laminated members are fabricated in a pattern of one of (i) isolated islands, (ii) a mesh, (iii) a ladder, and (iv) branches of a tree.

(12) A plasma display device according to (10), wherein said laminated members are comprised of electrical insulators.

(13) A plasma display device according to (10), wherein said laminated members are comprised of electrical conductors.

(14) A plasma display device according to (10), wherein said laminated members are comprised of a combination of an electrical insulator and an electrical conductor.

(15) A plasma display device according to (10), wherein said laminated members are electrically insulated from said electrodes for applying voltages to said discharge cells.

(16) A plasma display device according to (10), wherein a portion of each of said laminated members is electrically connected to a portion of said electrodes for applying voltages to said discharge cells and forms part or an entirety of said electrodes.

(17) A plasma display device according to (13), wherein said electrodes for applying voltages to said discharge cells form at least part of display electrodes for producing discharge for a display, form at least two kinds of electrodes, X electrodes and Y electrodes, and portions of each of said laminated members form part or an entirety of said X and Y electrodes.

(18) A plasma display device according to (10), wherein the following inequality is satisfied: $Lave/hd<1$.

(19) A plasma display device according to (10), wherein said substance which generates visible light is a phosphor film which generates visible light excited by ultraviolet light produced by said discharge, and said BM height hd is an average of distances between a surface of said phosphor film and a phosphor-film-side surface of said laminated members.

(20) A plasma display device according to (10), wherein said laminated members are disposed on or within said front substrate.

The structures in accordance with the present invention are capable of realizing a high-contrast plasma display panel with degradation in display brightness being suppressed.

BRIEF DESCRIPTION OF THE DRAWINGS

In the accompanying drawings, in which like reference numerals designate similar components throughout the figures, and in which:

FIG. 8(*b*) is a front view of a plasma display panel in accordance with an example of the present invention;

FIG. 8(*c*) is a front view of a plasma display panel in accordance with an example of the present invention;

FIG. 8(*d*) is a front view of a plasma display panel in accordance with an example of the present invention;

FIG. 8(*e*) is a front view of a plasma display panel in accordance with an example of the present invention;

FIG. 9(*b*) is a front view of still another structure of a plasma display panel to which the present invention is applicable;

FIG. 9(*c*) is a front view of still another structure of a plasma display panel to which the present invention is applicable;

FIG. 9(*d*) is a cross-sectional view of still another structure of a plasma display panel to which the present invention is applicable;

FIG. 9(*e*) is a cross-sectional view of still another structure of a plasma display panel to which the present invention is applicable;

FIG. 13(*b*) is a front view of a plasma display panel for explaining a light-absorbing area in the light-emissive area of FIG. 13(*a*);

FIG. 17(*b*) is a graph showing relationships between aperture ratios and figures of merit;

DETAILED DESCRIPTION OF THE PREFERRED EMBODIMENTS

Figure 1:
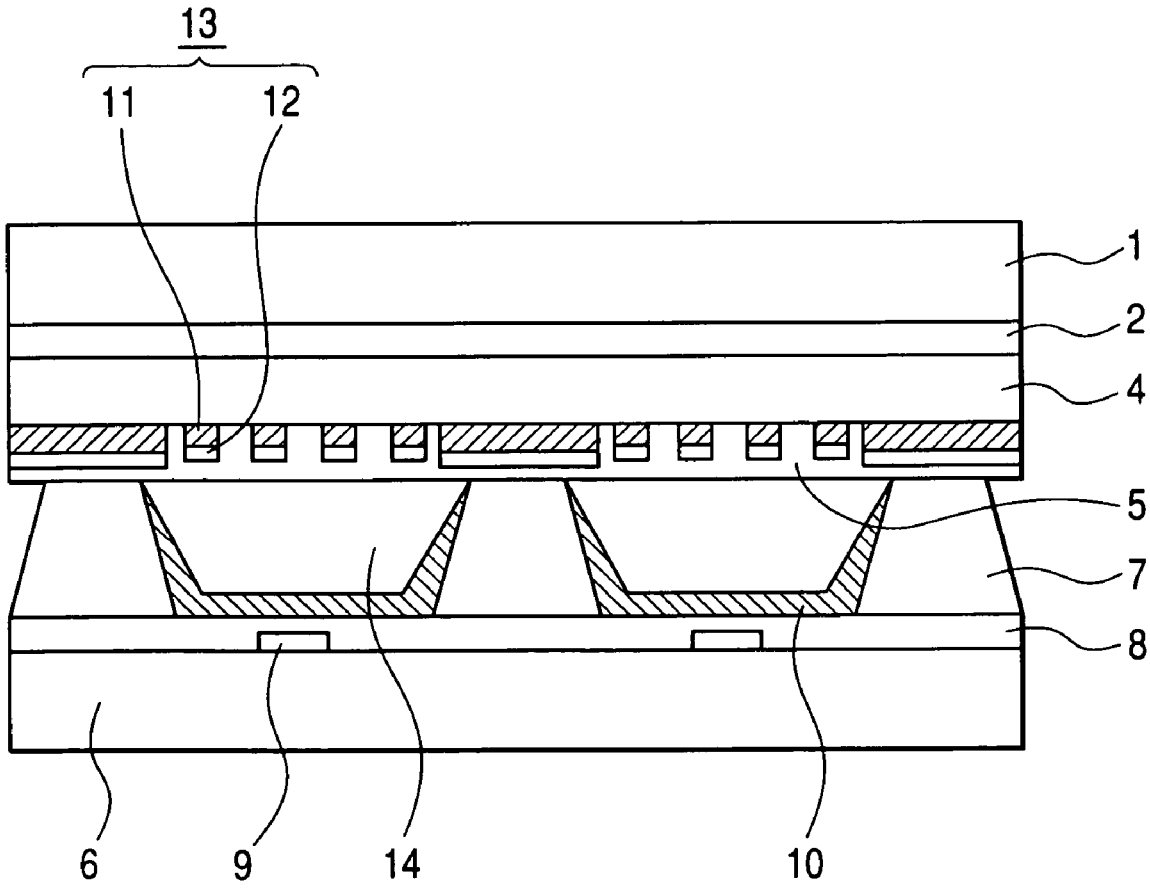
FIG. 1 schematically illustrates a plasma display panel in accordance with the present invention, and is a cross-sectional view of a plasma display panel in accordance with the present invention of FIG. 6 taken along line I-I' of FIG. 6.

An embodiment in accordance with the present invention will be explained in detail with reference to FIGS. 1, 6, 7 and 8(*a*)-8(*e*). The same reference numerals or symbols designate functionally similar parts or portions throughout the figures, and repetition of their explanation is omitted.

Figure 6:
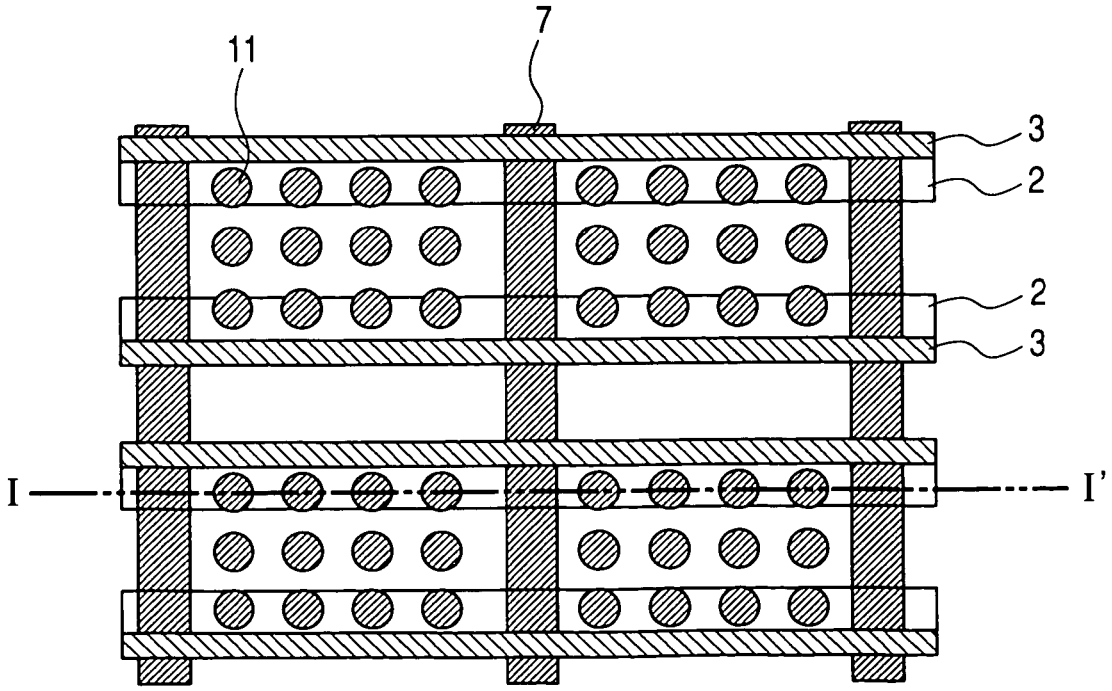
FIG. 6 is a schematic front view of a plasma display panel in accordance with the present invention.

FIG. 6 is a front view of an example of a plasma display panel in accordance with the present embodiment, and FIG. 1 is a cross-sectional view of the plasma display panel of FIG. 6 taken along line I-I' of FIG. 6.

Figure 2:
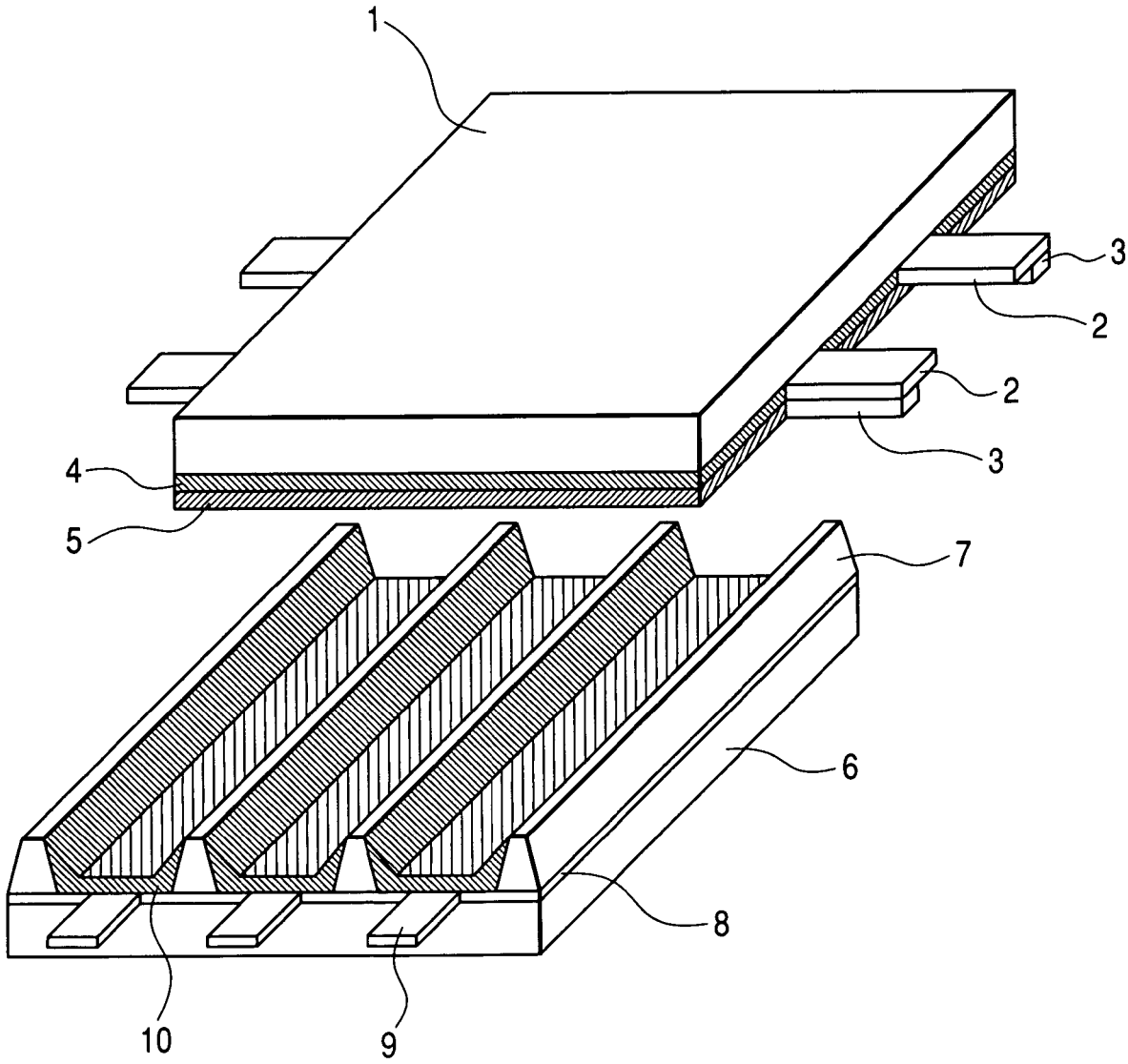
FIG. 2 is an exploded perspective view illustrating a structure of a plasma display panel.
Figure 3:
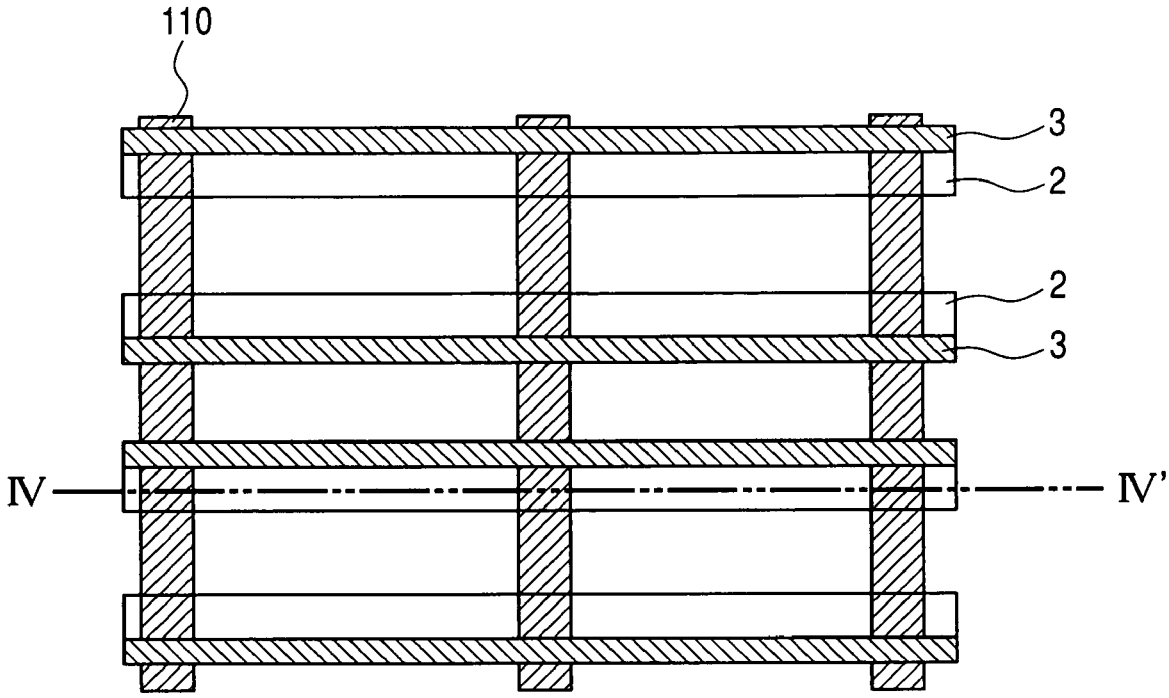
FIG. 3 is a front view of a conventional plasma display panel.
Figure 4:
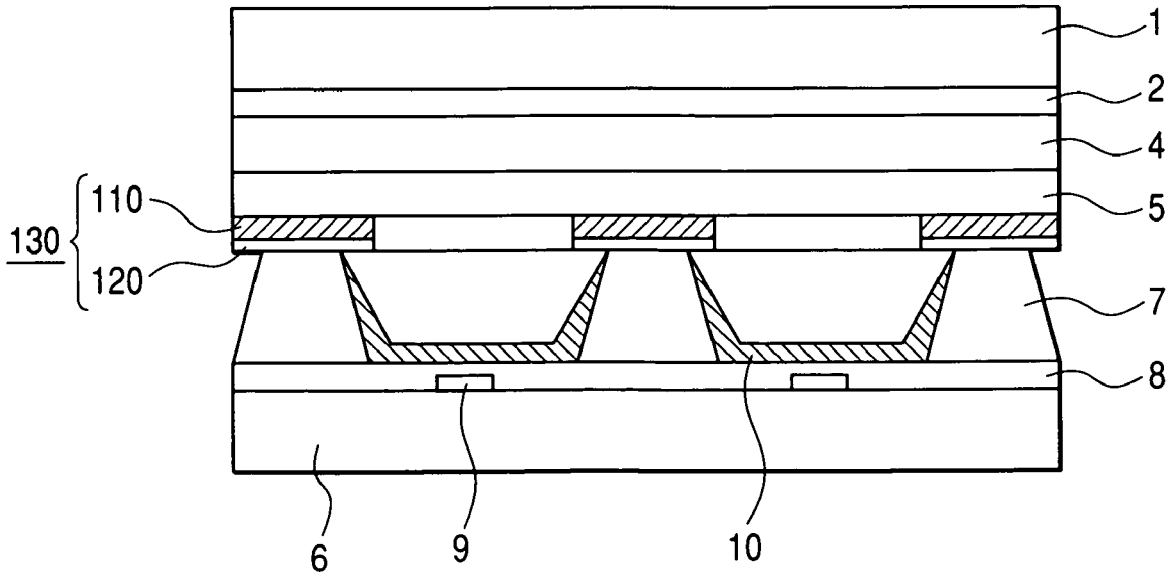
FIG. 4 is a cross-sectional view of the conventional plasma display panel of FIG. 3 taken along line IV-IV' of FIG. 3.

The basic structure of the plasma display panel in accordance with the present embodiment is similar to that explained already in connection with FIG. 2. The plasma display panel of this embodiment has a structure in which front and rear substrates are attached together and a discharge gas is filled therebetween. The front substrate includes a plurality of electrode pairs each comprised of a transparent electrode 2 and a bus electrode 3 for producing a sustain discharge disposed on a front glass plate 1. The electrode pairs are covered with a dielectric 4 and a protective film 5. The rear substrate includes address electrodes 9 disposed on a rear glass plate 6, and the address electrodes 9 are covered with a dielectric 8. Barrier ribs 7 are disposed on the dielectric 8, and red, blue and green phosphor films 10 are disposed between the barrier ribs 7, respectively.

The front and rear substrates are aligned with each other and are sealed together such that the electrodes on the front substrate intersect those on the rear substrate at right angles. A space between the two substrates is filled with a discharge gas, and thereby a plurality of cells are formed. A discharge is created in a desired one of the plurality of cells, by selectively applying appropriate voltages to the sustain electrode pairs on the front substrate and the address electrodes on the rear substrate. By this main discharge, vacuum ultraviolet light is produced, emission of red, blue and green lights is generated from the respective ones of the red, blue and green phosphor films 10 excited by the produced vacuum ultraviolet light, thereby producing a full-color display.

This embodiment has features that the plasma display panel is provided with laminated members each comprising at least a light absorption layer disposed on a side of the plasma display panel on which ambient light is incident and a light reflection layer disposed on a side of the plasma display panel facing toward a discharge space of the plasma display panel, and that the laminated members are dispersed in a plane parallel with the front substrate within each of the discharge cells.

First, the laminated member and a display surface from which visible light for display is emitted will be explained. Here consider one discharge cell. A discharge space is defined as a space in which a discharge for an image display is generated. A display surface is defined as a surface obtained by expanding over the entire cell an area where the laminated members are formed, or is defined as a surface obtained by expanding over the entire cell an area of the front substrate in contact with the discharge space. The thus-defined display surface is usually in parallel with the surface of the front glass plate 1. A visual field space is defined as a space into which the visible light for display is projected through the display surface. A discharge-space side is defined as a side of the display surface where the discharge space is located, and a visual-field-space side is defined as a side of the display surface where the visual field space is located. The above-mentioned phrase "a laminated member comprising at least a light absorption layer and a light reflection layer" means that at least a light absorption layer and a light reflection layer are laminated in a direction perpendicular to the display surface, and is intended here to include a laminated member comprising a light absorption layer, a light reflection layer and another layer exhibiting properties other than light absorption and light reflection and interposed between the light absorption layer and the light reflection layer, or laminated on the outside surface of the laminate of the light absorption layer and the light reflection layer.

As shown in FIG. 6 which is a front view of an example of a plasma display panel in accordance with the present embodiment and FIG. 1 which is a cross-sectional view of the plasma display panel of FIG. 6 taken along line I-I' of FIG. 6, the laminated members (hereinafter called the laminated members BM (Black Matrix) or called simply BM or the black matrix) 13 is formed by laminating together a light absorption layer 11 disposed on a side of the plasma display panel on which ambient light is incident and a light reflection layer 12 disposed on a side of the plasma display panel facing toward a discharge space 14, a phosphor-film-10 side, of the plasma display panel. That is to say, the light absorption layers 11 are disposed on a visual-field-space side and the light reflection layer 12 are disposed on a discharge-cell-14 side (the phosphor-film-10 side) Further the plural laminated members 13 are dispersed in a plane parallel with the front substrate within each of the discharge cells.

Figure 7:
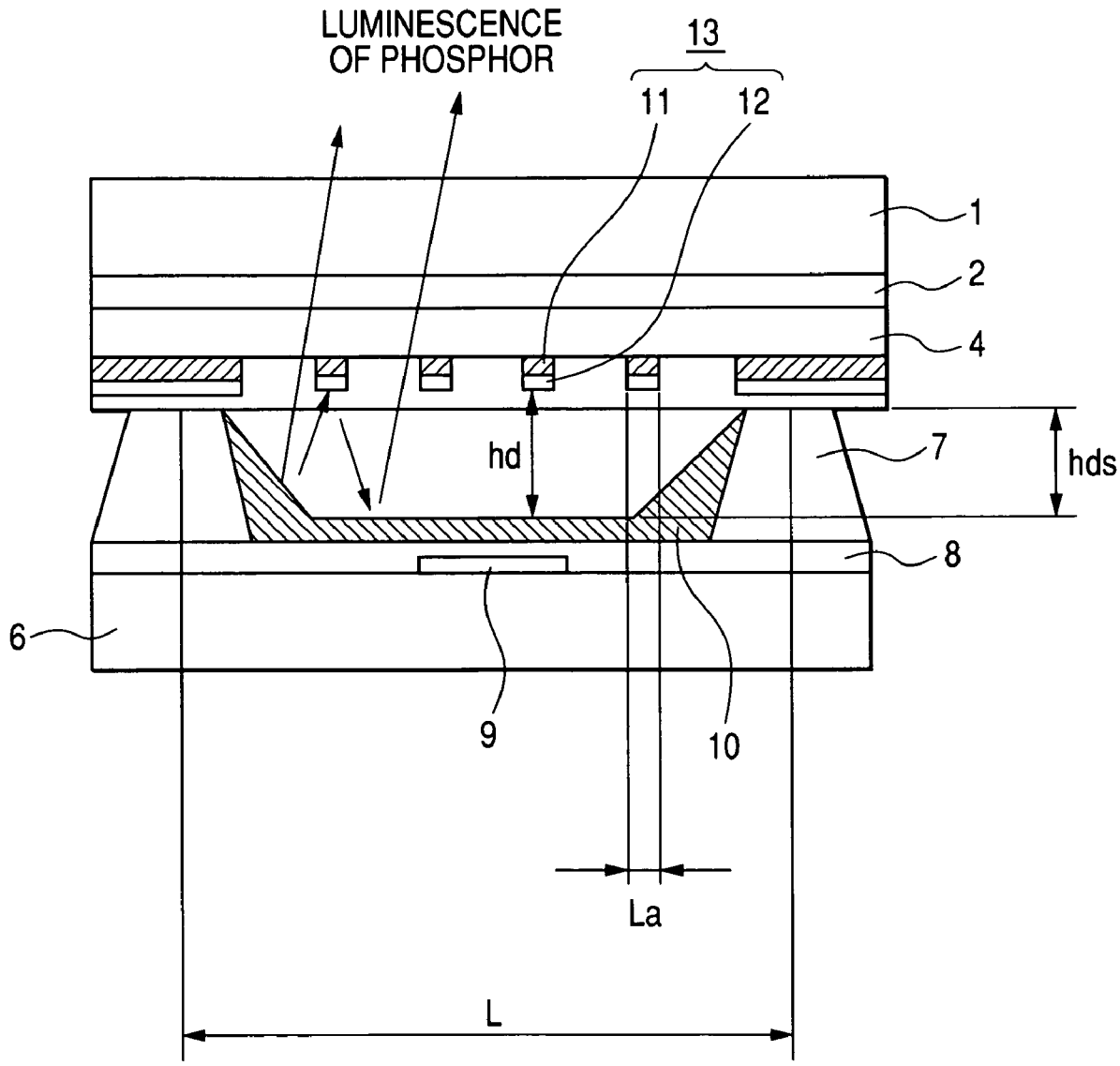
FIG. 7 is a cross-sectional view of a plasma display panel in accordance with the present invention of FIG. 6 taken along line I-I' of FIG. 6 for explaining reflection of light emitted from a phosphor film.
Figure 8A:
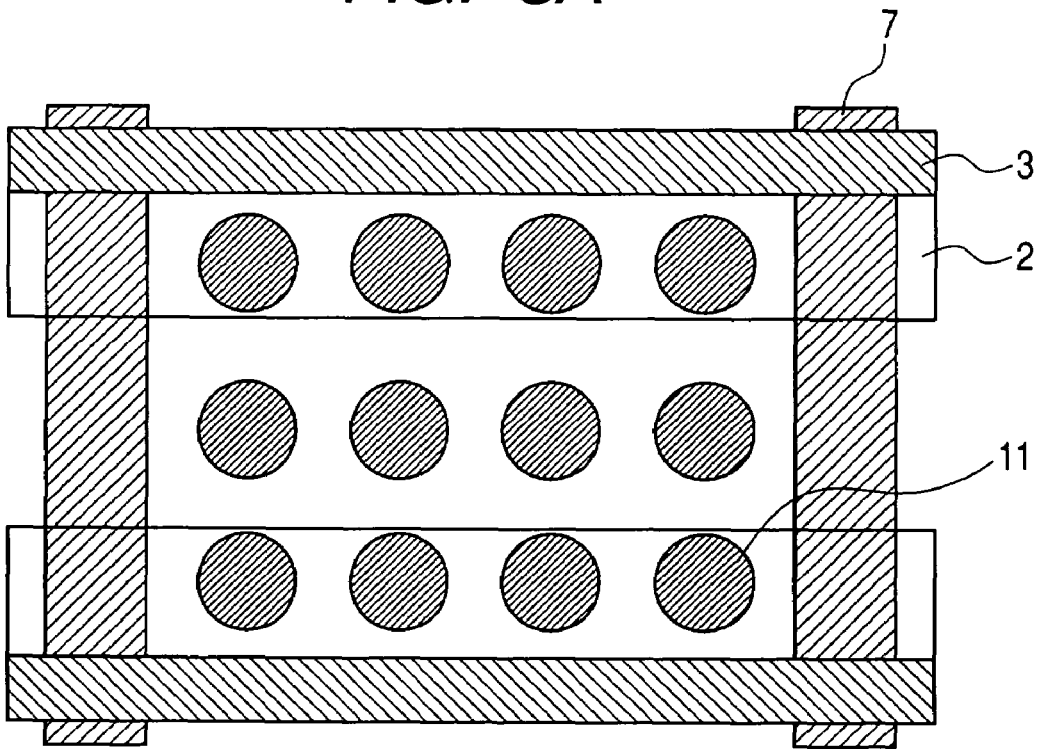
FIG. 8(*a*) is a front view of a plasma display panel in accordance with an example of the present invention.
Figure 8B:
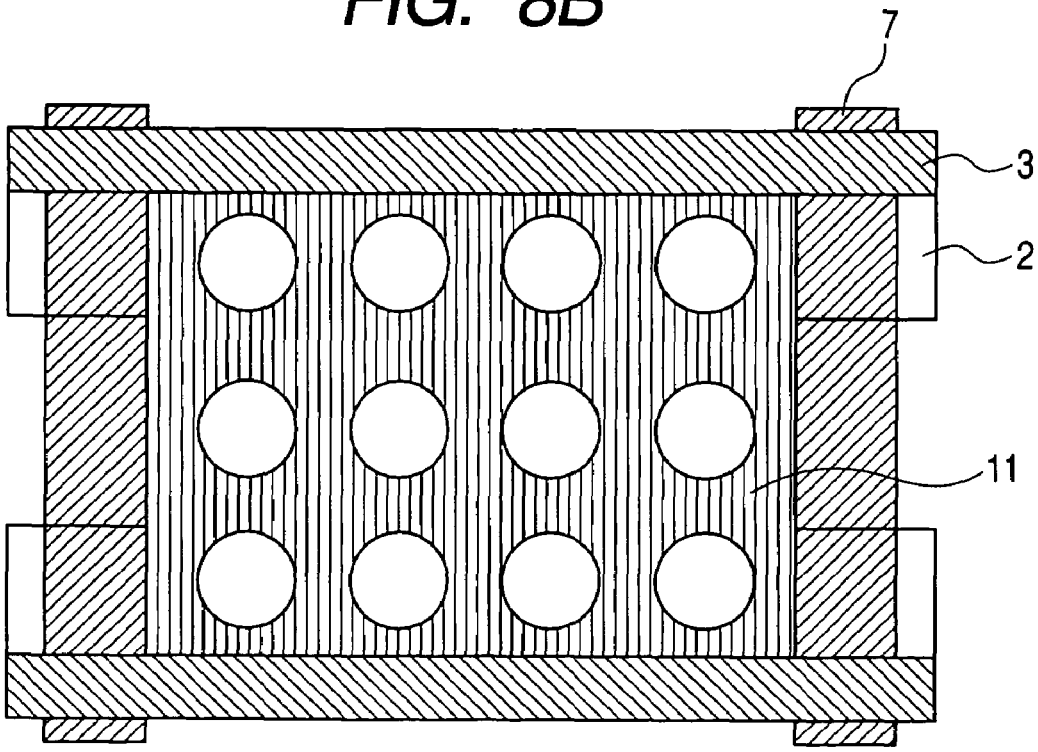
Figure 8C:
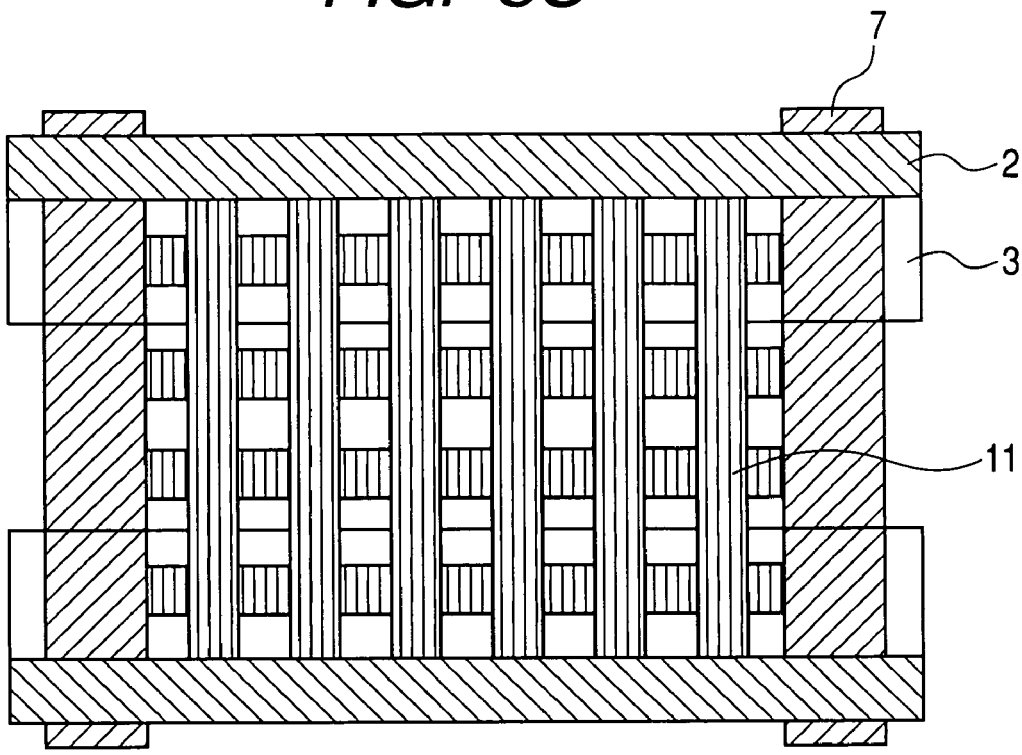
Figure 8D:
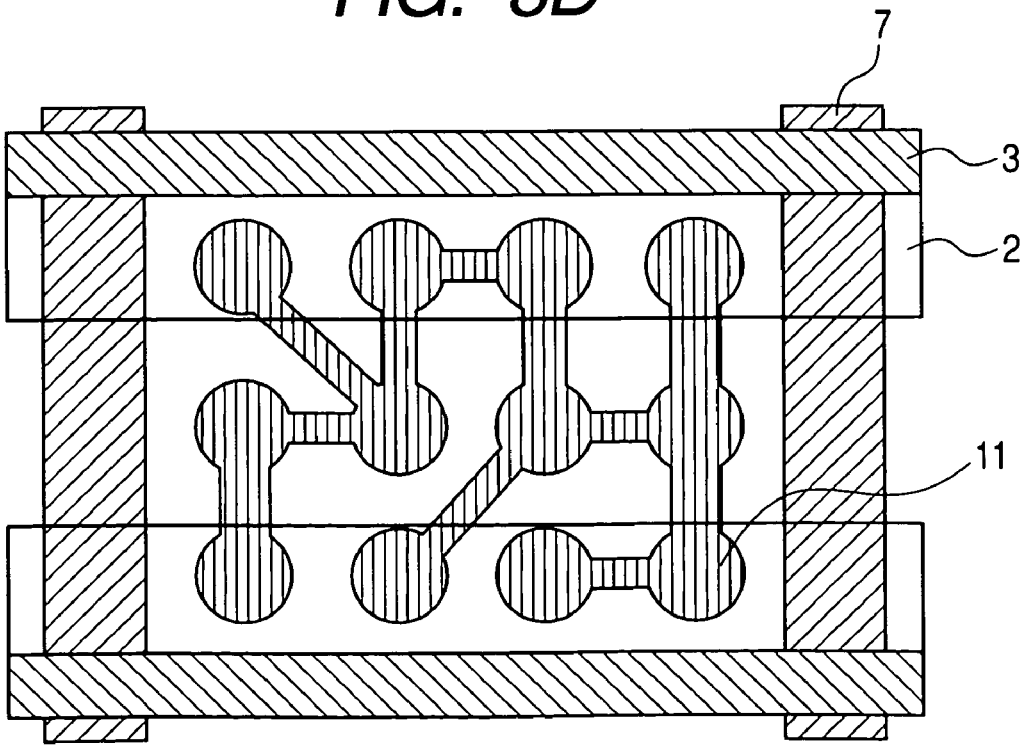
Figure 8E:
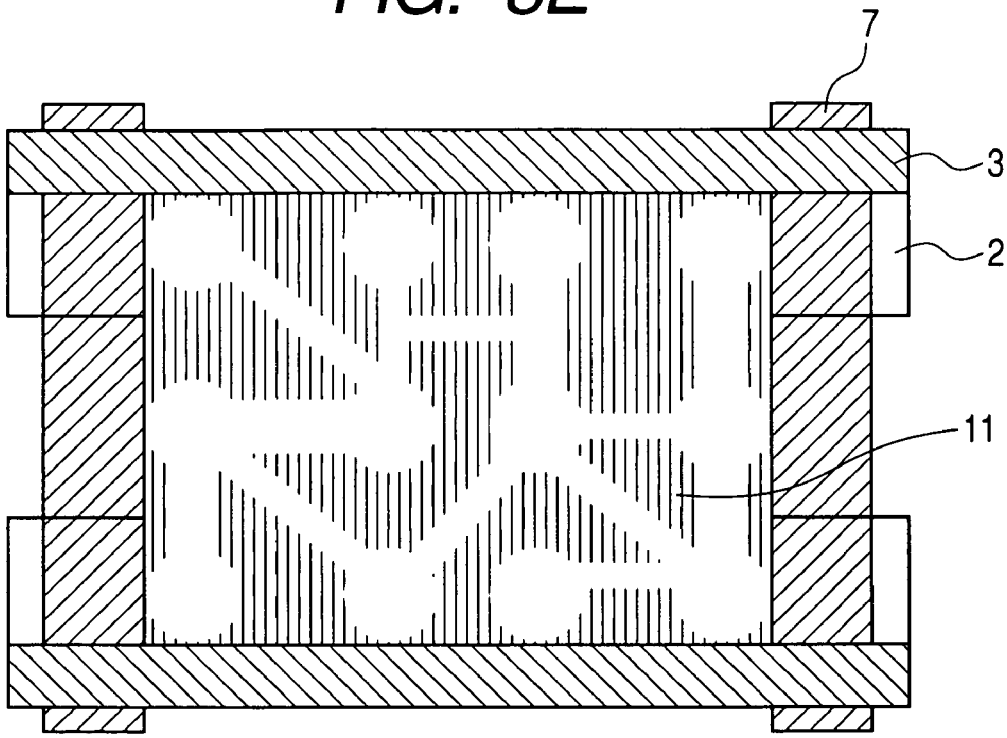
Figure 9A:
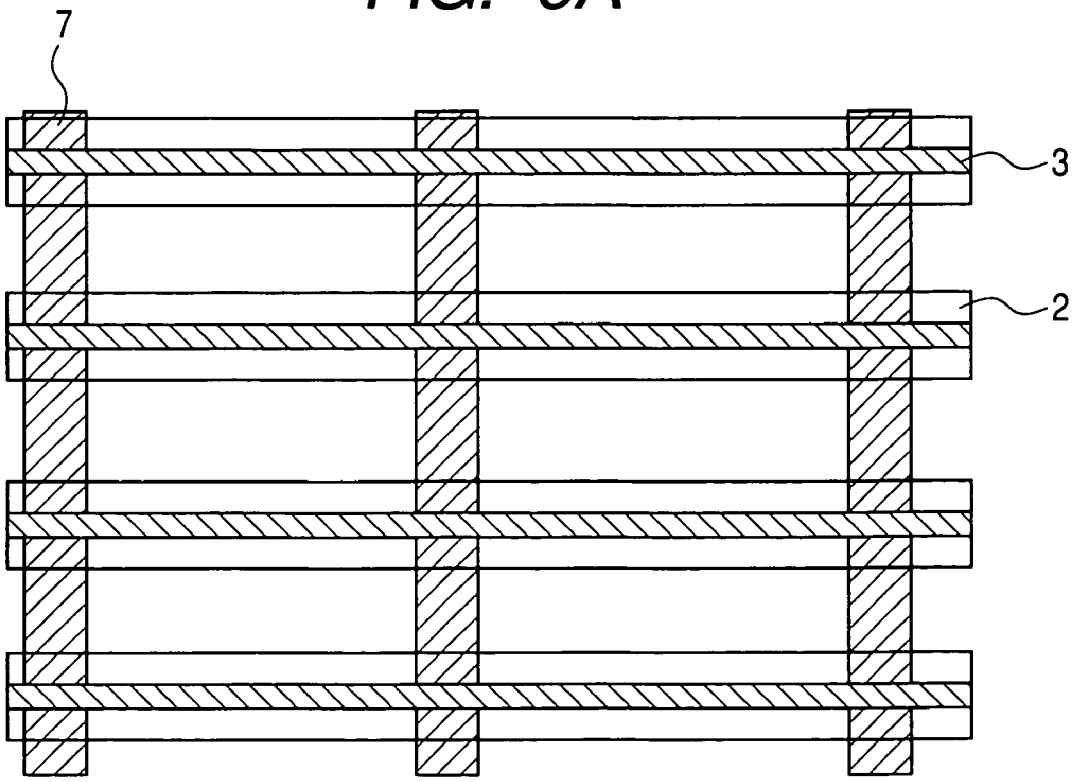
FIG. 9(*a*) is a front view of another structure of a plasma display panel to which the present invention is applicable.
Figure 9B:
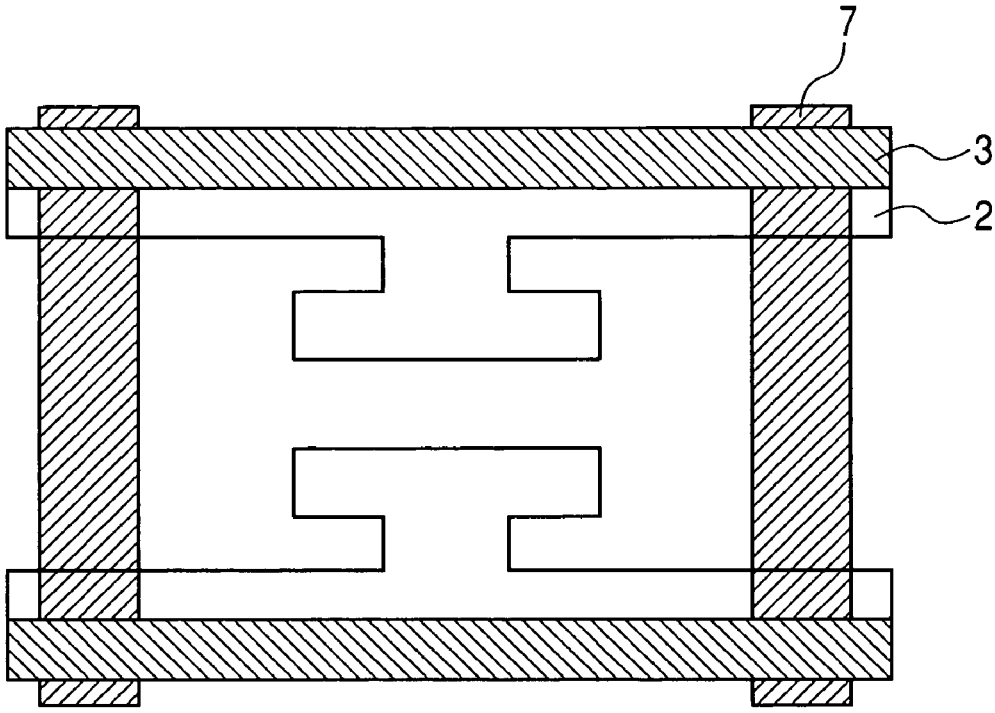
Figure 9C:
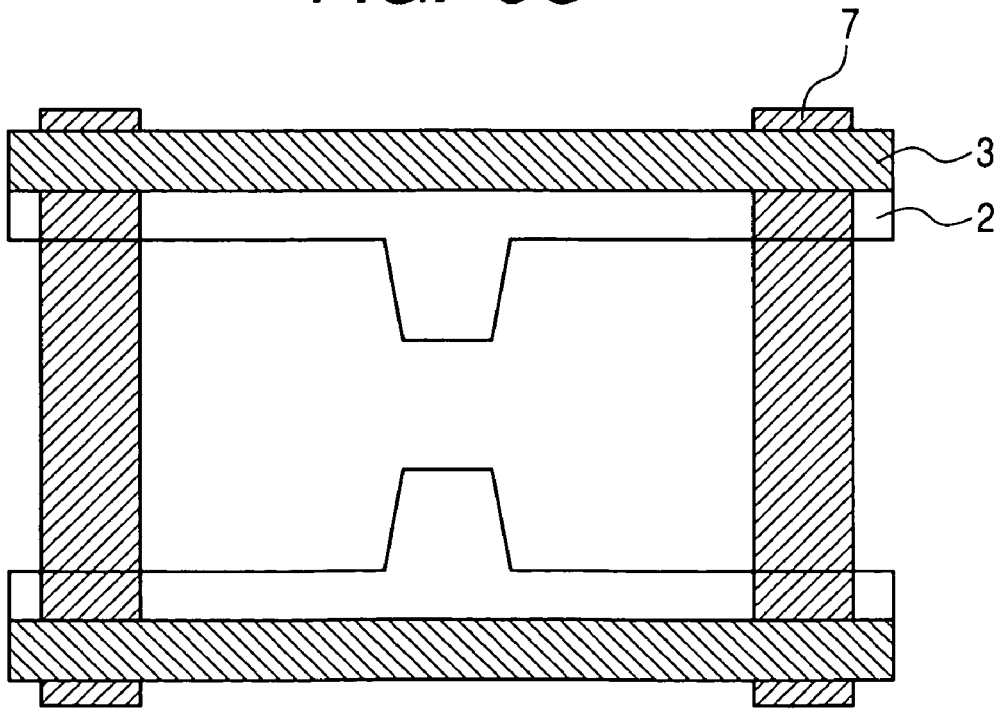
Figure 9D:
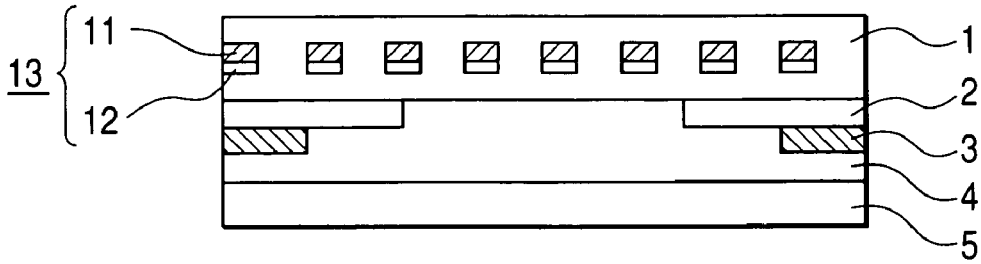
Figure 9E:
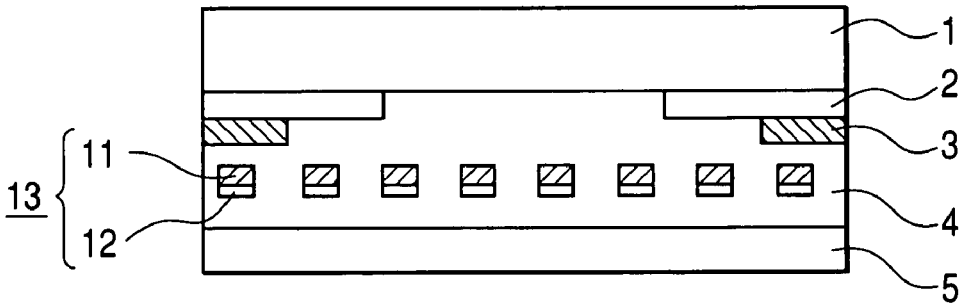

That is to say, in the present embodiment, the laminated members 13 each comprised of the light absorption layer 11 and the light reflection layer 12 are dispersed in a plane parallel with the front substrate within each of the discharge cells with gaps (or opening as described later) interposed therebetween. Therefore, a portion of light from the phosphor film 10 at the peripheral portions of one discharge cell undergoes multiple reflections between the light reflection layers 12 of the laminated members 13 and the phosphor film 10, and thereafter is emitted to the outside of the plasma display panel. As shown in FIG. 7, since the laminated members 13 are dispersed with gaps interposed therebetween, the light from the phosphor film 10 are emitted through the gaps to the outside of the plasma display panel after undergoing a reduced number of multiple reflections.

Figure 5:
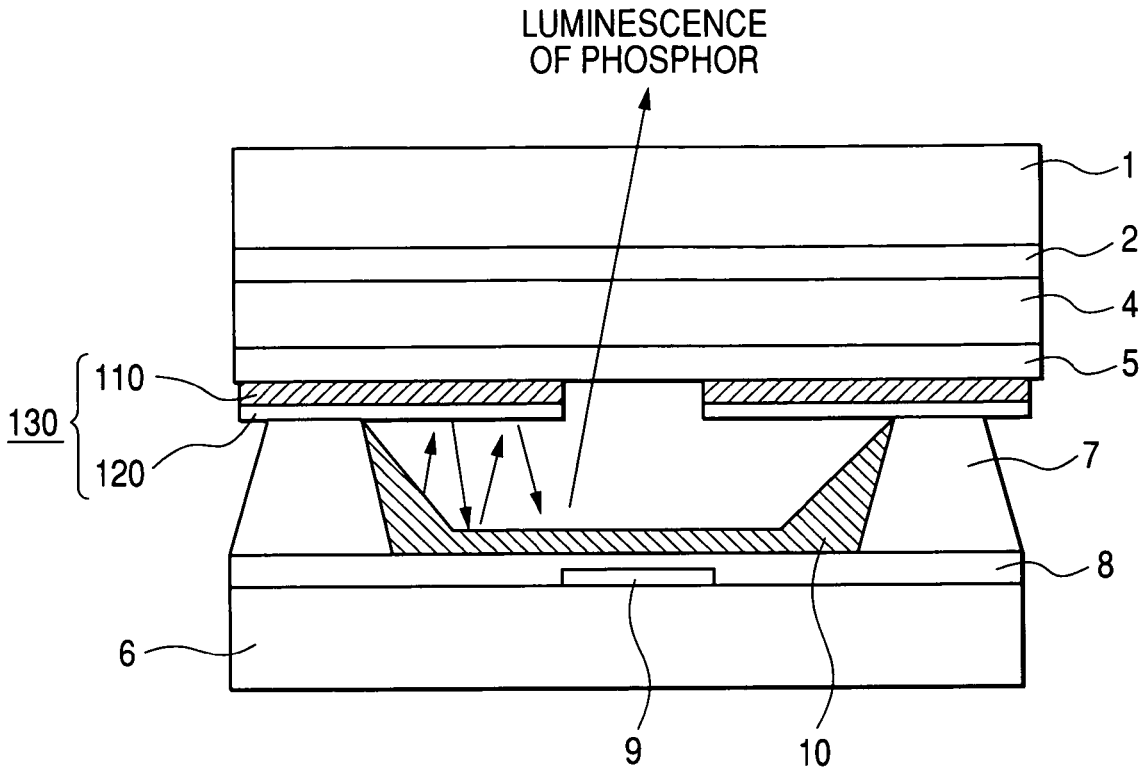
FIG. 5 is a cross-sectional view of the conventional plasma display panel of FIG. 3 taken along line IV-IV' of FIG. 3 for explaining reflection of light emitted from a phosphor film.

Consequently, compared with the case of the conventional technique explained in connection with FIG. 5, the present embodiment reduces the number of times each light from the phosphor film 10 is reflected. Therefore, attenuation of light is reduced, and the degradation of display brightness can be suppressed. Further, the area occupied by the light absorption layer 11 within each of the discharge cells can be selected so as to obtain the required display contrast.

The following will explain an example of a method of determining the size of the laminated member 13. In FIGS. 6 and 7, the size La of the laminated member 13 is defined as follows. Consider a cross section along a given line on a front view of a plasma display panel shown in FIG. 6, and by way of example, here consider a cross section shown in FIG. 7, which is a cross section taken along line I-I' of FIG. 6. The size La of the laminated member 13 is defined as the smallest length of the laminated member 13 in the cross section of FIG. 7. The cross section to be considered can be taken along a line extending in any directions in the display surface of the plasma display panel, other than the line I-I'. In this embodiment, it is desirable that the size La of the laminated member 13 and the cell size L (see FIG. 7) are selected to satisfy the following inequality in at least one cross section of the plasma display panel.

$$0<(La/L)\leqq 0.5$$

The reason is that it is preferable to increase the number of the laminated members disposed within each of the discharge cells by making the laminated members as small as possible.

Dispersion of the laminated members 13 comprised of the light absorption layer 11 and the light reflection layer 12 can be realized by the following ways, for example: Plural laminated members 13 may be dispersed in a pattern of isolated islands as illustrated in FIG. 8(*a*); the laminated members 13 may be integrally fabricated to form a unitary structure perforated with plural openings as illustrated in FIG. 8(*b*); the laminated members 13 may be integrally fabricated to form a unitary mesh-shaped structure perforated with plural square or rectangular openings as illustrated in FIG. 8(*c*); the laminated members 13 may be formed in a pattern of branches of a tree as illustrated in FIG. 8(*d*); the laminated members 13 may be integrally fabricated to form a unitary structure perforated with an opening of a pattern of branches of a tree as illustrated in FIG. 8(*e*); or the laminated members 13 may be formed in a pattern of a ladder.

In the following, the light absorption layer 11 and the light reflection layer 12 will be discussed. Consider a case where visible light falls on a layer and a portion of the visible is absorbed. An absorption coefficient is defined as a ratio of the absorbed energy of the visible light to all the energy of the incident visible light. A layer is called a light absorption layer which has an absorption coefficient higher than that of a common material. Usually the absorption coefficient of the light absorption layer is equal to or higher than 0.5, and therefore, to obtain the pronounced advantages of the present invention, it is preferable to select the absorption coefficient of the light absorption layer to be 0.7 or more, 0.9 or more, or 0.95 or more as required.

Next, consider a case where visible light falls on a surface of a layer and a portion of the visible is reflected. The mode of the light reflection may be a specular reflection or a diffuse reflection.

A reflectance is defined as a ratio of the reflected energy of the visible light to all the energy of the incident visible light. A layer is called a light reflection layer which has a reflectance higher than that of a common material. Usually the reflectance of the light reflection layer is equal to or higher than 0.5, and therefore, to obtain the pronounced advantages of the present invention, it is preferable to select the reflectance of the light reflection layer to be 0.7 or more, 0.9 or more, or 0.95 or more as required.

The light absorption layer 11 may be made of metals such as Cr or the like, or oxides such as chromium oxide, manganese dioxide, copper oxide or the like. The light reflection layer 12 may be made of metals such as Al, Ag, Au or the like, or oxides such as titanium oxide, aluminum oxide, silicon dioxide, tantalum oxide or the like. The laminated member 13 comprised of the light absorption layer 11 and the light reflection layer 12 may be fabricated by screen printing, a method by using a dispenser, or a photolithography.

By the way, application of the present invention is not limited to the structure of the plasma display panel illustrated as an example in FIG. 2, but is applicable to a structure of a plasma display panel which has transparent electrode regions 2 disposed on both sides of each of the bus electrodes 3 as shown in a front view in FIG. 9(*a*), and is also applicable to structures of plasma display panels employing electrodes 2 provided with projections as shown in FIGS. 9(*b*) and 9(*c*), respectively.

Further, the laminated members 13 may be disposed within the front glass plate 1 as shown in FIG. 9(*d*), or may be disposed within the layer of the dielectric 4 as shown in FIG. 9(*e*).

The laminated members 13 of the present embodiment are disposed within the above-explained discharge spaces, between the discharge spaces and the front substrate, or within the front substrate. Especially, to simplify the structure of the plasma display panel, it is desirable to dispose the laminated members within the front substrate. Especially, when the laminated members 13 are embedded within the front glass plate 1 in advance as shown in FIG. 9(*d*), the manufacturing process for fabrication of the laminated members 13 is simplified and the practical value of this structure is great. Further, the laminated members 13 may be embedded within the layer of the dielectric 4 which covers the electrode pairs for sustain discharge as shown in FIG. 9(*e*). In this case, the laminated members 13 can be fabricated in a process step separate from that of fabricating the electrodes, and the manufacturing process can be made easier.

Further, in a case where the dielectric 4 is fabricated by using a material in the form of a sheet fabricated beforehand, the laminated members 13 can be embedded within the material in the form of a sheet beforehand, and this can make the manufacturing step more low-cost and more highly reliable. In this case, plural sheet-like materials may be used, the laminated members 13 can be formed on one of the plural sheet-like materials, and the plural sheet-like materials can be attached together to form one sheet-like material.

Figure 10:
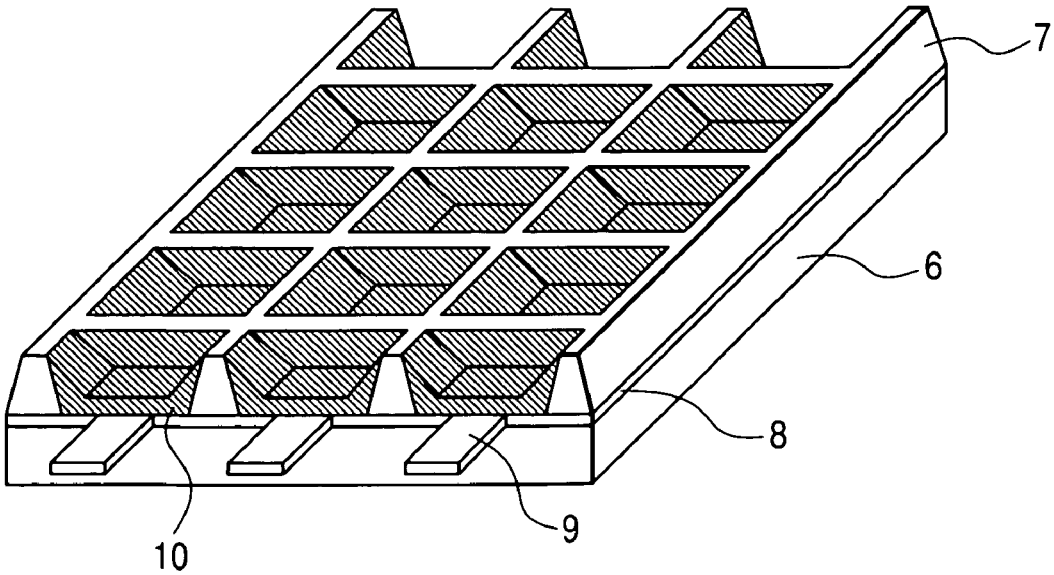
FIG. 10 is a perspective view of still another structure of a plasma display panel to which the present invention is applicable.

Further, in a case where the electrode pairs for sustain discharge (hereinafter called the sustain-discharge electrode pairs) are in the form of a letter T as shown in FIG. 9(*b*), or are provided with projections as shown in FIG. 9(*c*), if the T-shaped portions or the projections are made of the laminated members 13 (or portions of the laminated members 13), this configuration provides the great practical value. The reason is that the width of the T-shaped portions or the projections is narrow, therefore Lave which will be explained later becomes small, and Lave/hd can be made small easily. Further, the present invention is also applicable to a structure of a plasma display panel employing barrier ribs 7 in the form of a grid as shown in FIG. 10.

COMPARATIVE EXAMPLE

Figure 11:
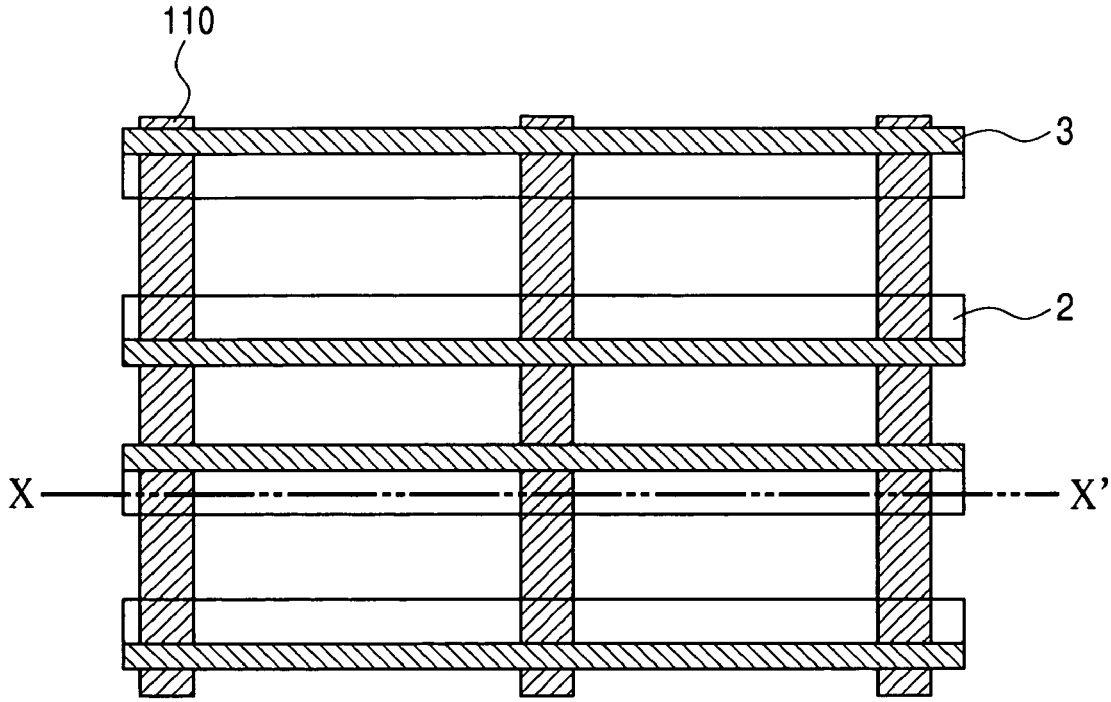
FIG. 11 is a front view of a structure for explaining a plasma display panel serving as a comparative example.
Figure 12:
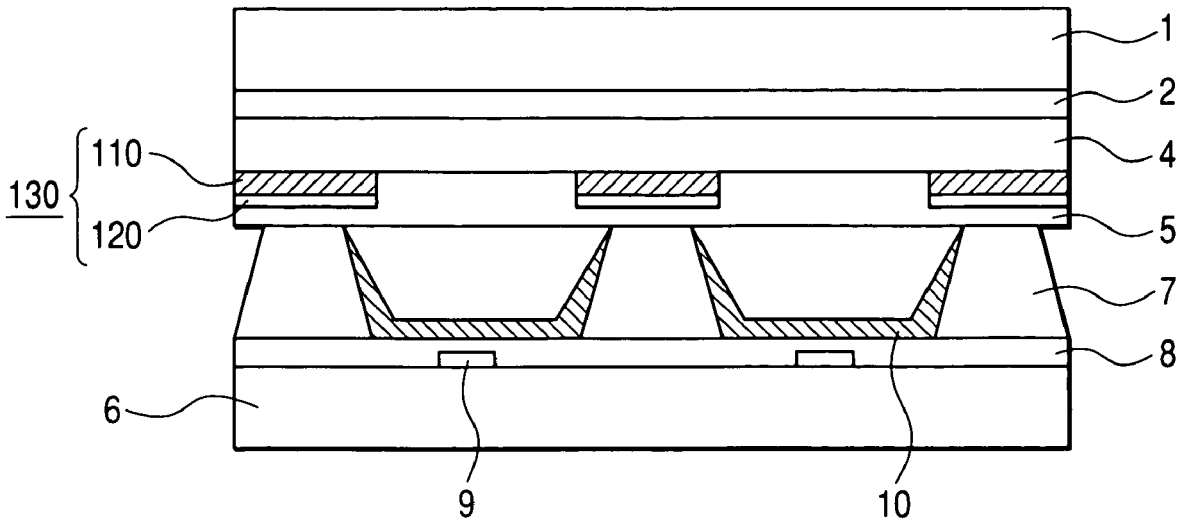
FIG. 12 is a cross-sectional view of the plasma display panel serving as the comparative example of FIG. 11 taken along line X-X' of FIG. 11.

Fabricated for comparison purposes are plasma display panels employing laminated members comprised of the light absorption layer and the light reflection layer which are approximate in plan-view shape to an entire or partial contour of each of the discharge cells, and which are in the form of stripes disposed along the peripheries of each of the discharge cells. FIG. 11 is a front view of the comparative sample of the plasma display panel, and FIG. 12 is a cross-sectional view of the comparative sample of FIG. 11 taken along line X-X' of FIG. 11. The laminated members 130 comprised of the light absorption layer 110 and the light reflection layer 120 were fabricated in the form of stripes on the surface of the same front substrate as that of the plasma display panel already explained in connection with FIG. 2.

Initially, a paste composed of chromium oxide particles, low-melting glass powders, a binder and a solvent is prepared for the light absorption layer 110. The light absorption layer 110 made of chromium oxide was fabricated by coating the paste on the substrate by using a screen printing method, and then volatilizing the solvent drying the paste. Next, a paste composed of titanium oxide particles, low-melting glass powders, a binder and a solvent is prepared for the light reflection layer 120. This paste is coated so as to overlie the light absorption layer 110 by using a screen printing method to form the light reflection layer 120, and then the binder and the solvent are burnt out by drying and firing the paste.

In this way, the laminated members 130 comprised of the light absorption layer 110 and the light reflection layer 120 were fabricated in the form of stripes. The plasma display panels were fabricated by filling a discharge gas between the front and rear substrates and then sealing the front and rear substrates together. The plasma display panels having various aperture ratios were fabricated by varying the width of the laminated members 130 comprised of the light absorption layer 110 and the light reflection layer 120.

Figure 13A:
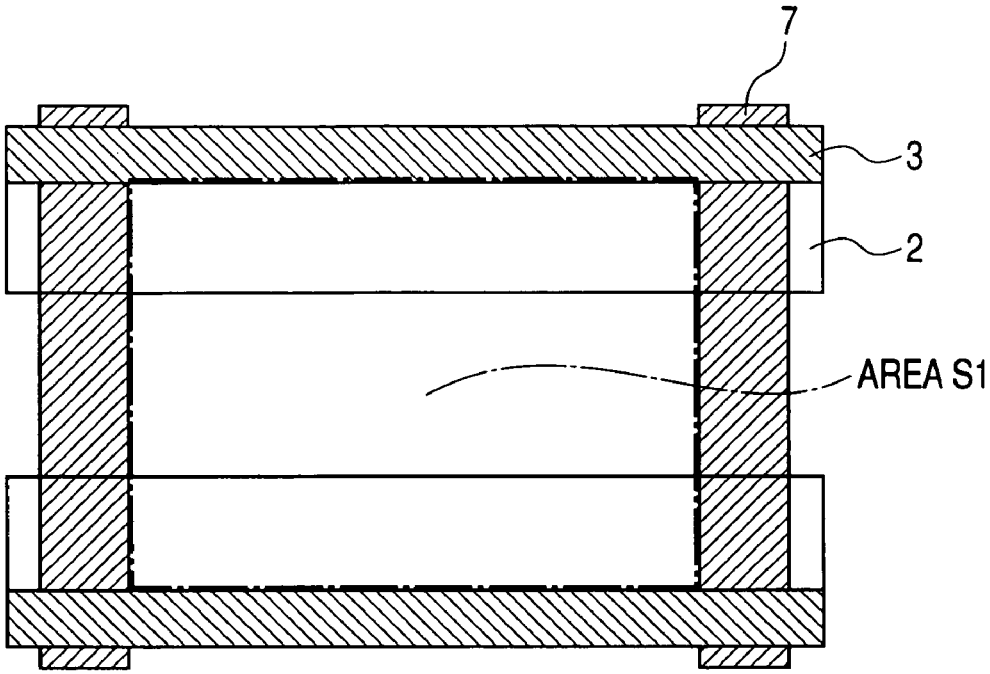
FIG. 13(*a*) is a front view of a plasma display panel for explaining its light-emissive area.
Figure 13B:
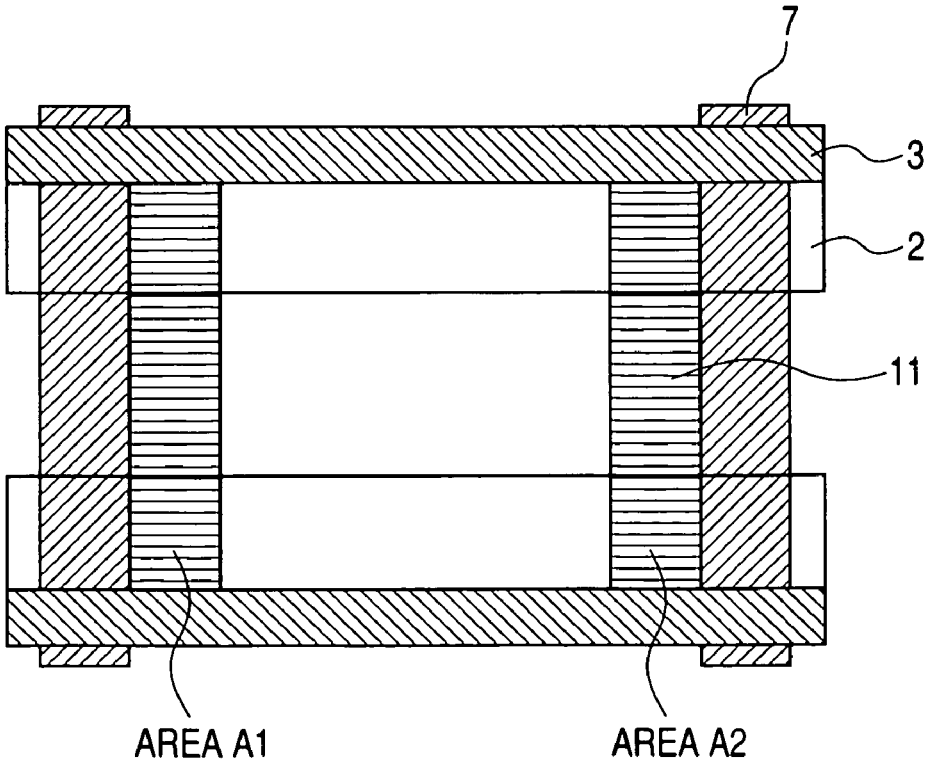

In a unit cell in a front view of the plasma display panel shown in FIG. 13(*a*), S1 is defined as a light-emissive area enclosed by dot-and-dash lines, and S2 is defined as the sum of areas occupied by the light absorption layers within the area S1. The sum S2 of areas of the light absorption layers in FIG. 13(*b*) is the sum of an area A1 and an area A2. The aperture ratio is defined as (S1−S2)/S1 based upon the above definitions.

In the following, examples employing various shapes of the laminated members will be explained, and in these examples the aperture ratio will be defined as described above.

EXAMPLE 1

Figure 14:
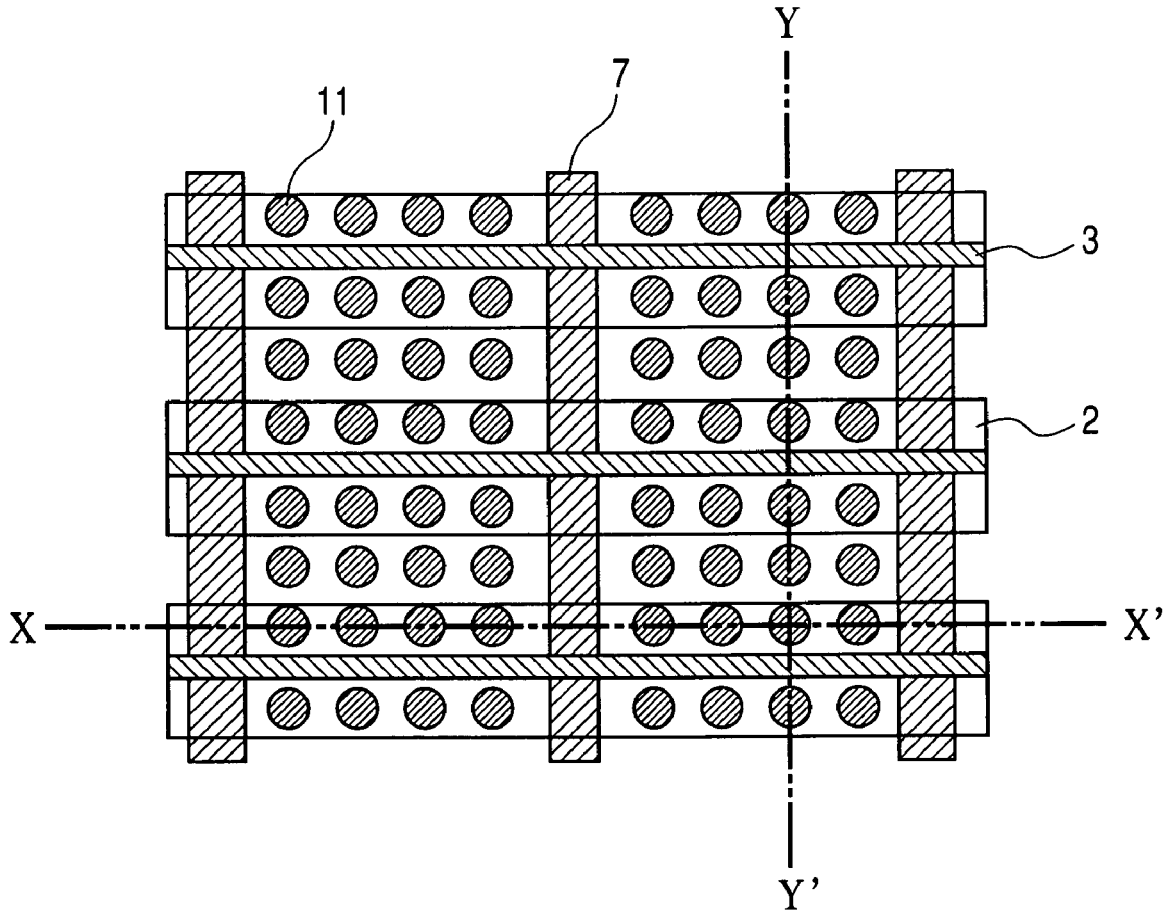
FIG. 14 is a schematic front view of Example 1 of the present invention.
Figure 15:
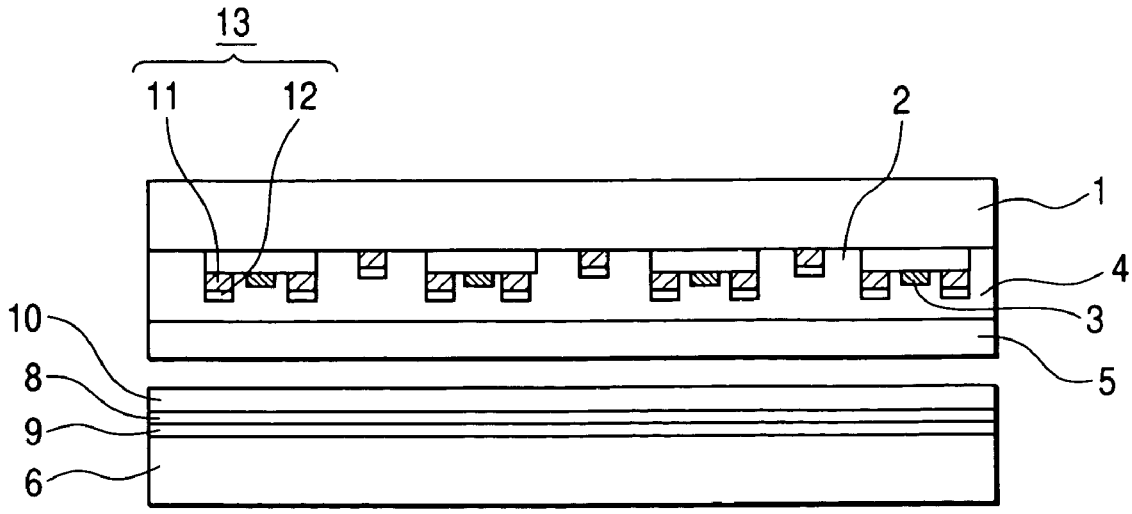
FIG. 15 is a cross-sectional view of Example 1 of FIG. 14 taken along line Y-Y' of FIG. 14.
Figure 16:
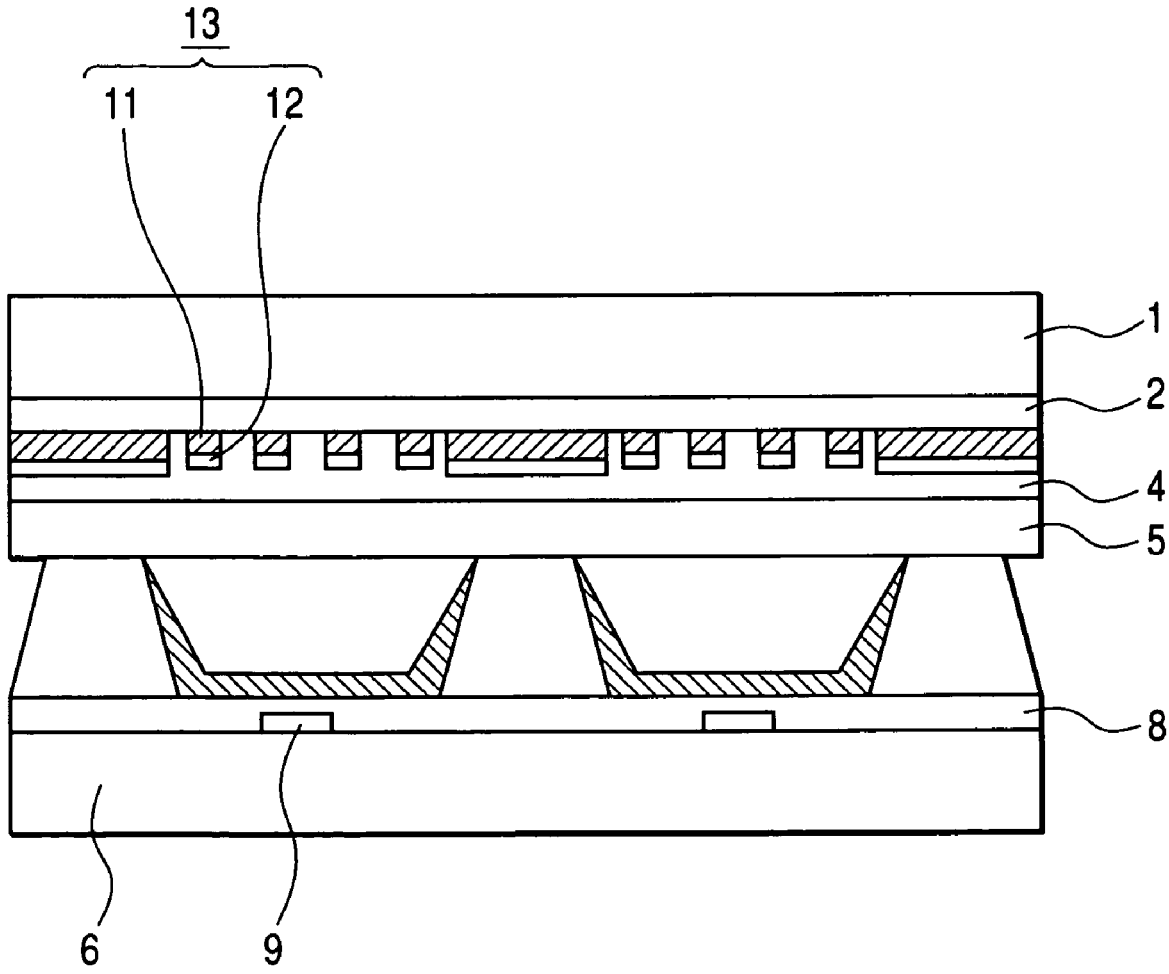
FIG. 16 is a cross-sectional view of Example 1 of FIG. 14 taken along line X-X' of FIG. 14.

FIG. 14 is a front view of a structure of a plasma display panel in accordance with Example 1, FIG. 15 is a cross-sectional view of the structure of FIG. 14 taken along line Y-Y' of FIG. 14, and FIG. 16 is a cross-sectional view of the structure of FIG. 14 taken along line X-X' of FIG. 14.

After electrodes 2 and 3 were fabricated on the front substrate, the laminated members 13 comprised of the light absorption layer 11 and the light reflection layer 12 were fabricated. The light absorption layers 11 were made of chromium oxide.

Initially, a paste composed of chromium oxide particles, low-melting glass powders, a binder and a solvent is prepared for the light absorption layers 11. The paste is coated on the substrate by using a screen printing method, and then the solvent was volatilized by drying the paste. Next, the light reflection layers 12 made of titanium oxide were fabricated. Initially, a paste composed of titanium oxide particles, low-melting glass powders, a binder and a solvent is prepared for the light reflection layer 12. This paste is coated so as to overlie the light absorption layer 11 by using a screen printing method to form the light reflection layer 120, and thereafter the binder and the solvent are burnt out by drying and firing the paste. Next, the dielectric 4 and the protective film 5 are fabricated to complete the front substrate. The plasma display panels were fabricated by filling a discharge gas between the front and rear substrates and then sealing the front and rear substrates together. Several plasma display panels having various aperture ratios were fabricated by adjusting the sizes and the number of the laminated members 13 comprised of the light absorption layer 11 and the light reflection layer 12.

Figure 17A:
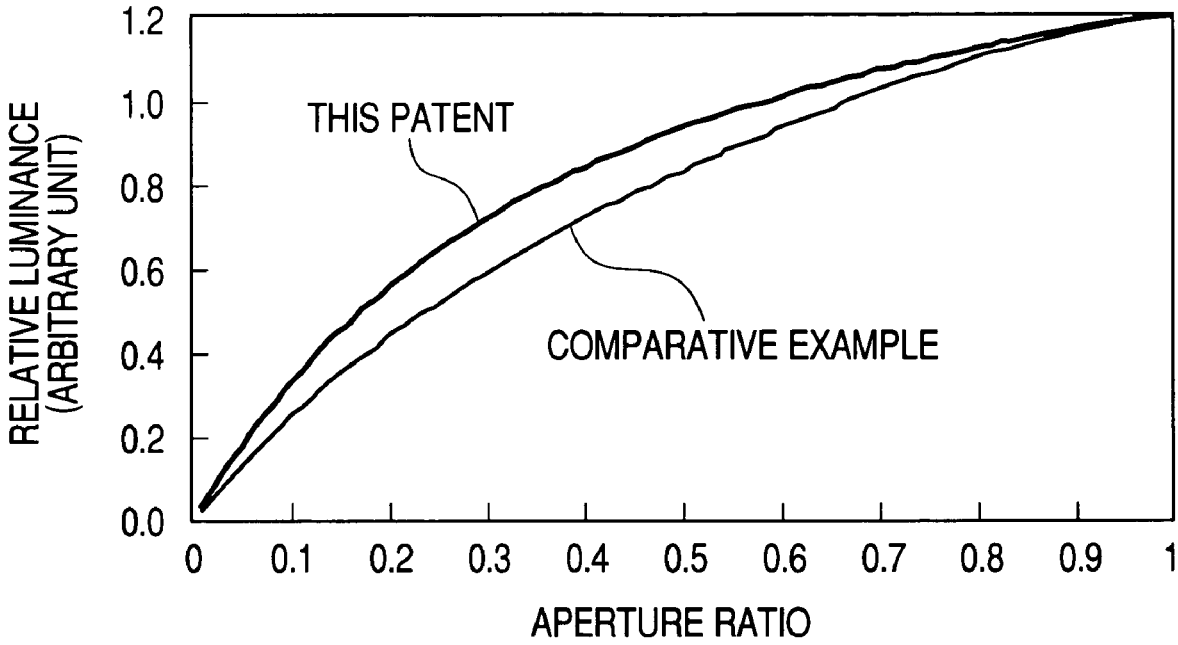
FIG. 17(*a*) is a graph showing relationships between aperture ratios and relative luminance.
Figure 17B:
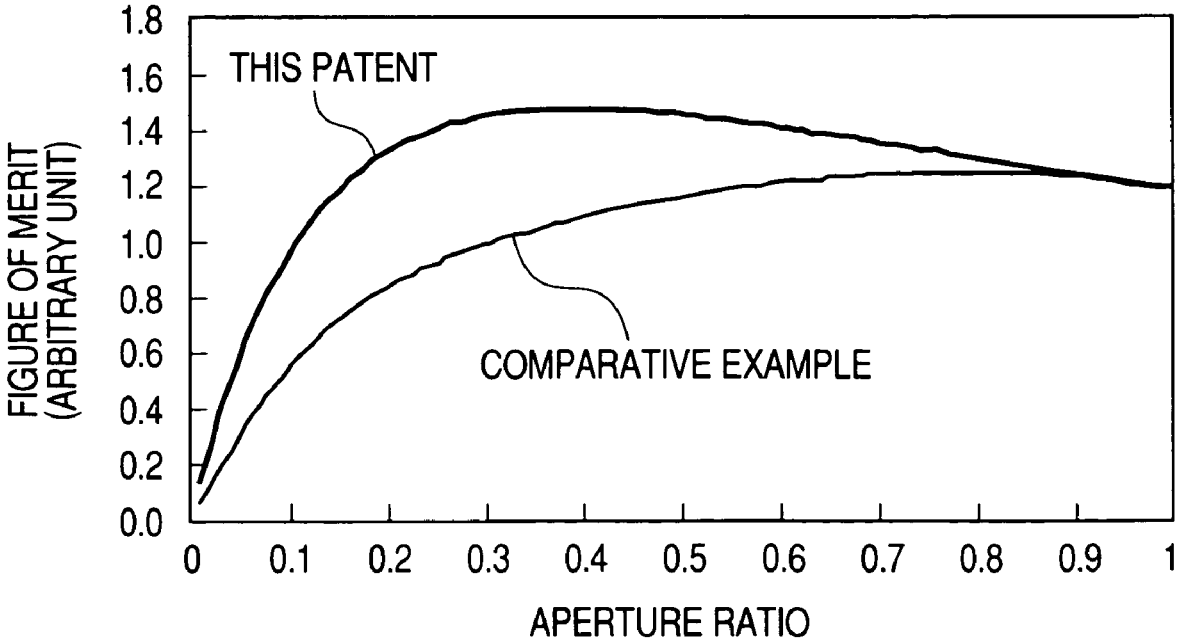

Display brightness of the plasma display panels of this example were measured by connecting a drive circuit to them. The plasma display panels of this example exhibited higher display contrasts compared with those of the plasma display panels which are not provided with the laminated members 13 comprised of the light absorption layer 11 and the light reflection layer 12. FIG. 17(*a*) shows results obtained by measuring display brightness of the plasma display panels of this example. This shows that display brightness was improved compared with the above-described comparative examples by dispersing the laminated members 13 comprised of the light absorption layer 11 and the light reflection layer 12 within each of the discharge cells. The performance of the plasma display panels needs to be evaluated in terms of both display brightness and display contrast. Here, the figure of merit for the plasma display panel is defined as the product of display brightness and display contrast, and FIG. 17(*b*) shows results obtained by measuring the plasma display panels of this example.

The figures of merit of the structure of the plasma display panels of the present invention have exhibited 5% or more improvement over those of the comparative examples when the aperture ratio is in a range of from 0.1 to 0.8.

EXAMPLE 2

Figure 18:
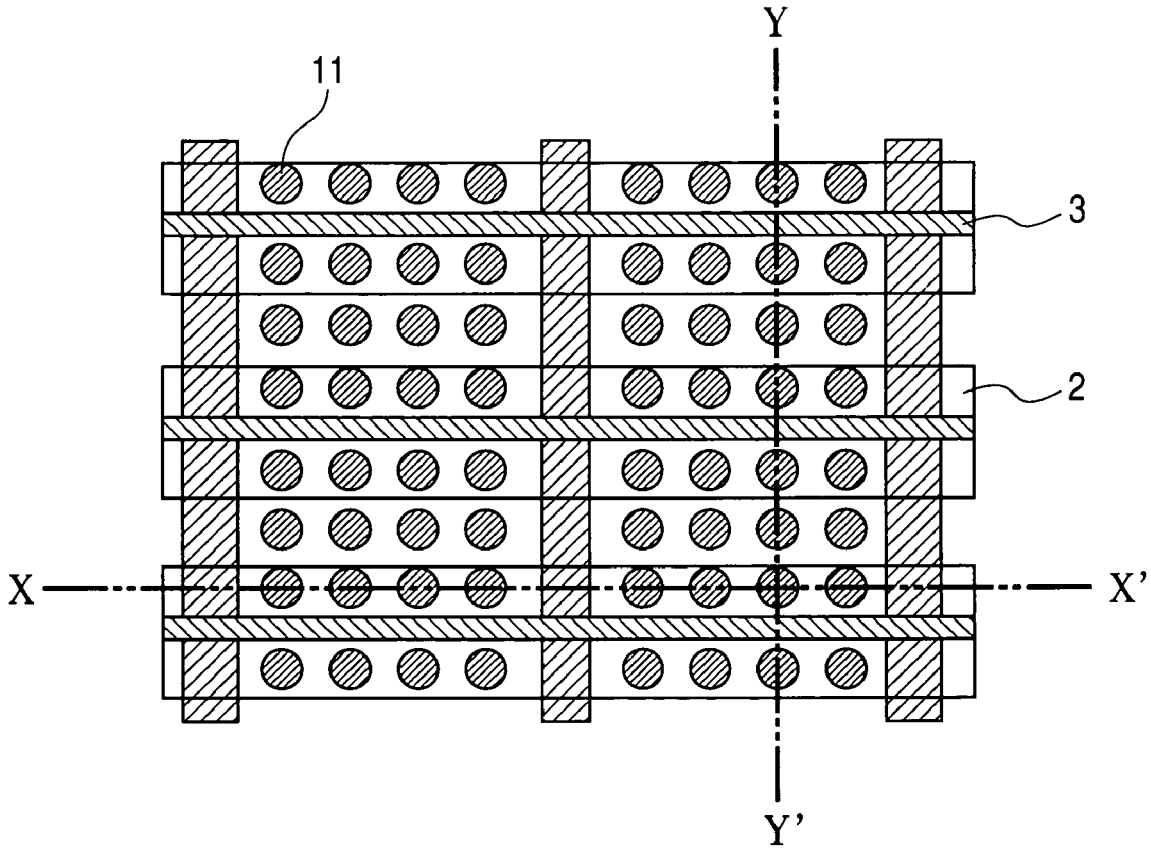
FIG. 18 is a schematic front view of Example 2 of the present invention.
Figure 19:
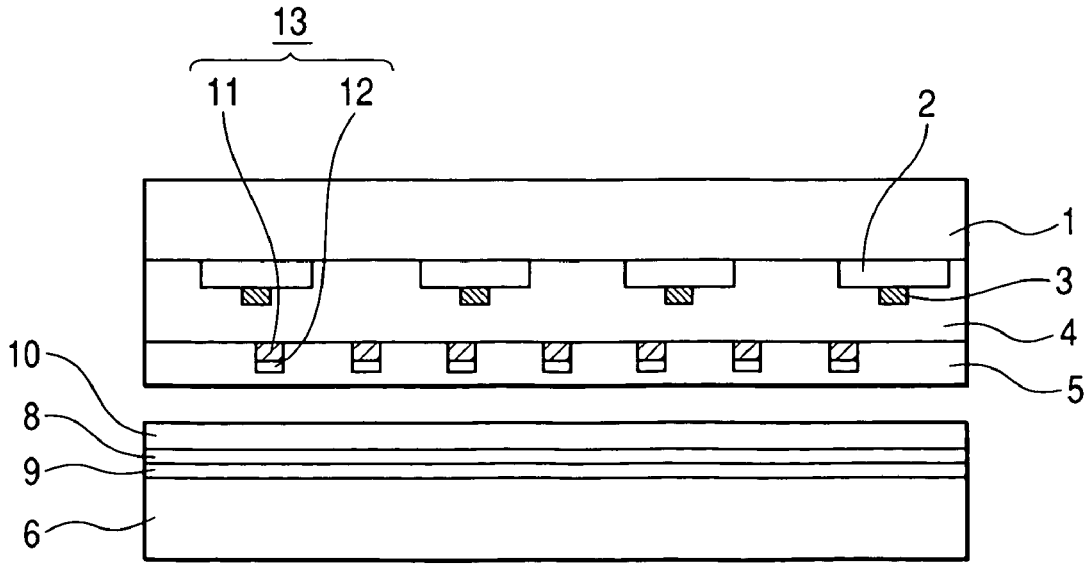
FIG. 19 is a cross-sectional view of Example 2 of FIG. 18 taken along line Y-Y' of FIG. 18.
Figure 20:
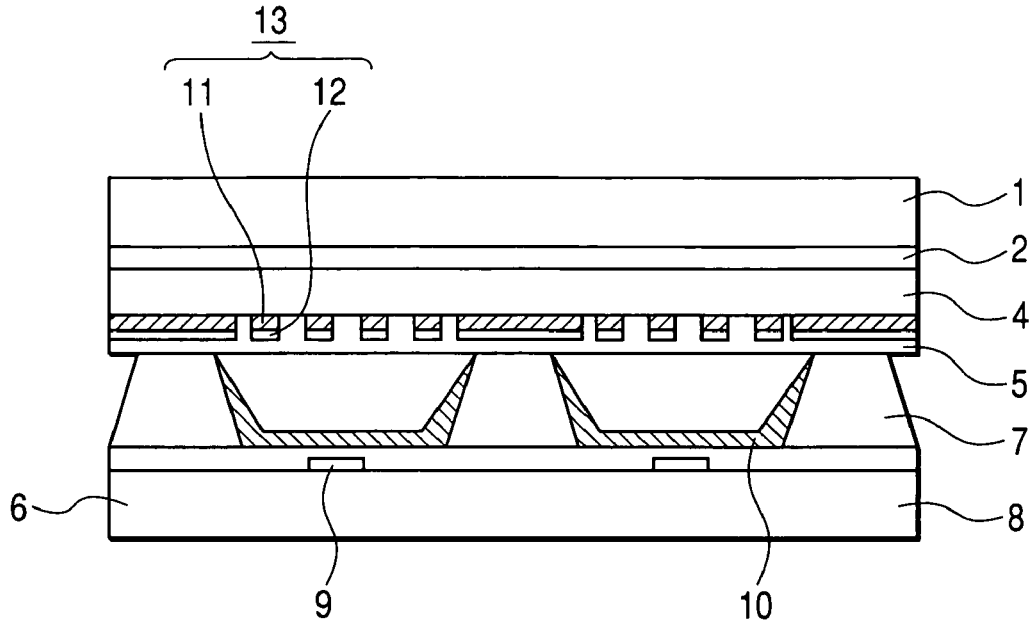
FIG. 20 is a cross-sectional view of Example 2 of FIG. 18 taken along line X-X' of FIG. 18.

FIG. 18 is a front view of a structure of a plasma display panel in accordance with Example 2, FIG. 20 is a cross-sectional view of the structure of FIG. 18 taken along line X-X' of FIG. 18, and FIG. 19 is a cross-sectional view of the structure of FIG. 18 taken along line Y-Y' of FIG. 18. The plasma display panels of Example 2 were fabricated in the same way as Example 1, except that the laminated members 13 comprised of the light absorption layer 11 and the light reflection layer 12 are disposed on the surface of the layer of the dielectric 4, and their display brightness was measured.

The plasma display panels of Example 2 have exhibited improvement in brightness over the above-described comparative examples with their aperture ratios being in a range of from 0.1 to 0.8, and an improvement in brightness was realized by dispersing the laminated members 13 comprised of the light absorption layer 11 and the light reflection layer 12 within each of the discharge cells.

EXAMPLE 3

This example is similar to Example 1, except that the laminated members 13 comprised of the light absorption layer 11 and the light reflection layer 12 were integrally fabricated to form a unitary structure perforated with plural openings as illustrated in FIG. 8(*b*). The display brightness of the fabricated plasma display panels of Example 3 was measured.

The plasma display panels of Example 3 have exhibited improvement in brightness over the above-described comparative examples with their aperture ratios being in a range of from 0.1 to 0.8, and an improvement in brightness was realized by dispersing the laminated members 13 comprised of the light absorption layer 11 and the light reflection layer 12 within each of the discharge cells.

EXAMPLE 4

This example is similar to Example 1, except that the laminated members 13 comprised of the light absorption layer 11 and the light reflection layer 12 were integrally fabricated to form a unitary mesh-shaped structure perforated with plural square or rectangular openings as illustrated in FIG. 8(*c*). The display brightness of the fabricated plasma display panels of Example 4 was measured.

The plasma display panels of Example 4 have exhibited improvement in brightness over the above-described comparative examples with their aperture ratios being in a range of from 0.1 to 0.8, and an improvement in brightness was realized by dispersing the laminated members 13 comprised of the light absorption layer 11 and the light reflection layer 12 within each of the discharge cells.

EXAMPLE 5

This example is similar to Example 1, except that the laminated members 13 comprised of the light absorption layer 11 and the light reflection layer 12 were formed in a pattern of branches of a tree as illustrated in FIG. 8(*d*). The display brightness of the fabricated plasma display panels of Example 5 was measured.

The plasma display panels of Example 5 have exhibited improvement in brightness over the above-described comparative examples with their aperture ratios being in a range of from 0.1 to 0.8, and an improvement in brightness was realized by dispersing the laminated members 13 comprised of the light absorption layer 11 and the light reflection layer 12 within each of the discharge cells.

EXAMPLE 6

This example is similar to Example 1, except that the laminated members 13 comprised of the light absorption layer 11 and the light reflection layer 12 were integrally fabricated to form a unitary structure perforated with an opening of a pattern of branches of a tree as illustrated in FIG. 8(*e*). The display brightness of the fabricated plasma display panels of Example 6 was measured. The plasma display panels of Example 6 have exhibited improvement in brightness over the above-described comparative examples with their aperture ratios being in a range of from 0.1 to 0.8, and an improvement in brightness was realized by dispersing the laminated members 13 comprised of the light absorption layer 11 and the light reflection layer 12 within each of the discharge cells.

EXAMPLE 7

Figure 21:
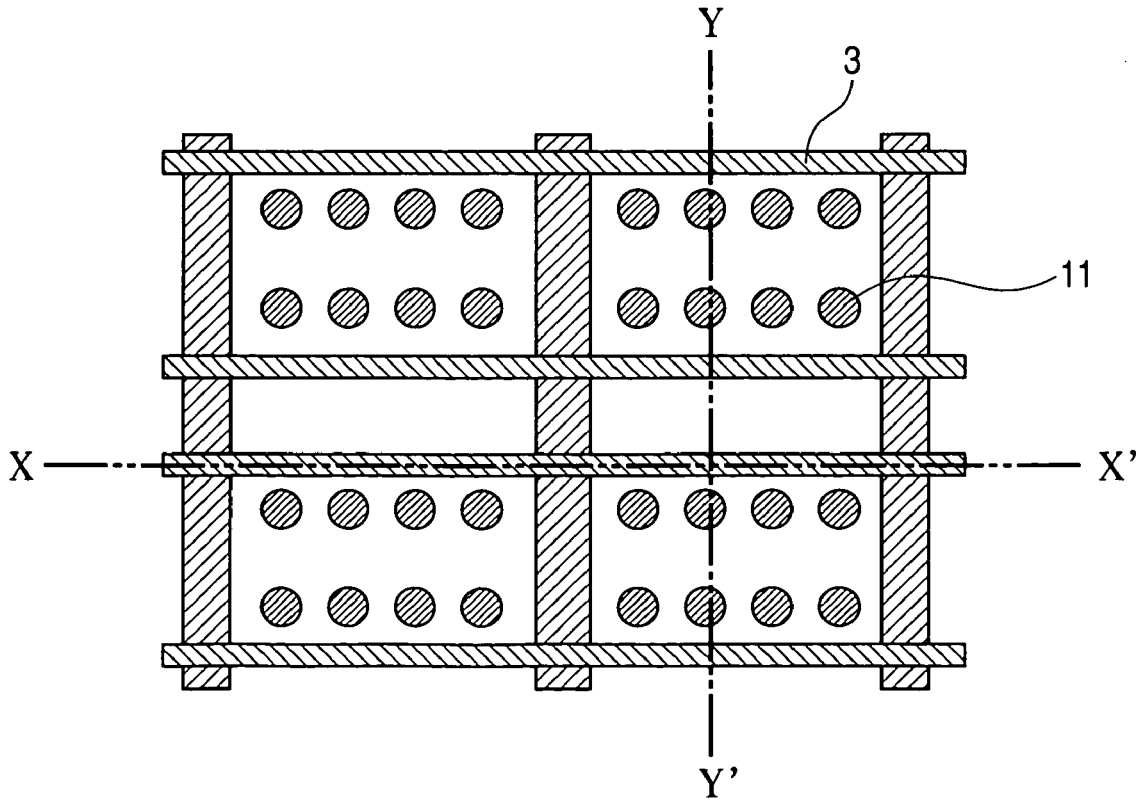
FIG. 21 is a schematic front view of Example 7 of the present invention.
Figure 22:
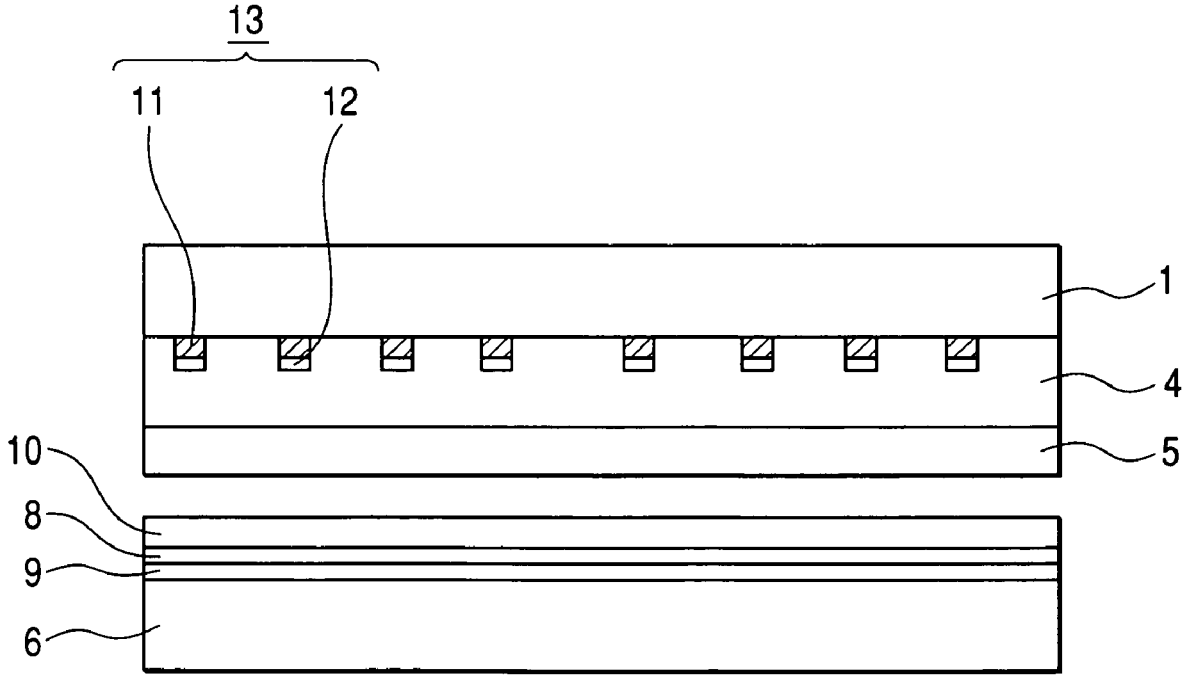
FIG. 22 is a cross-sectional view of Example 7 of FIG. 21 taken along line Y-Y' of FIG. 21.

FIG. 21 is a front view of a structure of a plasma display panel in accordance with Example 7, and FIG. 22 is a cross-sectional view of the structure of FIG. 21 taken along line Y-Y' of FIG. 21. The structure of Example 7 differs from that of the comparative examples, in that the electrodes disposed on the front substrate are comprised of the laminated members 13 comprising the light absorption layers 11 made of chromium and the light reflection layers 12 made of aluminum, and in that discharge is generated between the plural laminated members 13 and no transparent electrodes are present.

The plasma display panels of the above structure have exhibited improvement in brightness over the above-described comparative examples with their aperture ratios being in a range of from 0.1 to 0.8, and an improvement in brightness was realized by dispersing the laminated members 13 comprised of the light absorption layer 11 and the light reflection layer 12 within each of the discharge cells.

In the following, the laminated member BM in accordance with the present invention will be explained. The laminated member BM of the present invention formed on the front substrate comprises an electrical insulator, an electrical conductor, or a combination of both. The laminate members BM of the present invention are sometimes disposed electrically insulated from the electrode pairs each of which is formed of two electrodes each formed of lamination of a transparent electrode 2 and a bus electrode 3, and in some cases the laminate members BM of the present invention may not be insulated from the electrode pairs. Further, in some cases, portions of the laminate members BM may form portions or the entirety of the electrode pairs.

In the above-described embodiment, the high-brightness high-contrast plasma display panel is realized by considering only the conception of the laminated members 13 being dispersed in a given plane within each of the discharge cells, and in the following embodiment, the high-brightness high-contrast plasma display panel is realized by considering the discharge cells in three dimensions.

In the following, the length dbm of the size of the laminated member BM will be defined. Consider one of the discharge cells as in the case of the previous embodiment. A BM region is defined as a region occupied by the laminated member BM in the above-explained display surface. Visible light generated in the discharge space cannot enter the visual field space through the BM region because of the property of the BM region. A light-transmissive region is defined as a region in the display surface through which the visible light from the discharge space can enter the visual field space. A non-BM region is defined as a region in the display surface other than the BM region. Usually the light-transmissive region is the non-BM region. However, if there is a component which prevents the visible light from entering the visual field space from the discharge space, for example, bus electrodes 3, other than the laminated member BM, then the light-transmissive region is part of the non-BM region. Returning to FIG. 7, consider an arbitrary point A in the BM region. Dbm-A is defined as the shortest distance between the point A and the light-transmissive region. The length Lave of the size of the laminated member BM is defined as the value of the dbm-A averaged over the entire BM region. Since it is preferable to increase the number of the laminated members disposed within each of the discharge cells by making the laminated members as small as possible, it is desirable to select the ratio of Lave to L to be ½ or smaller, where L is a typical size of the cell (See FIG. 7).

That is to say, it is desirable that $Lave/L \leqq 1/2$. Further, in a case where the phosphor film 10 reflects the visible light diffusely, for the purpose of reducing the number of multiple reflections it is desirable that Lave<hd (i.e. $0<Lave/hd<1$), where hd is a BM height which is the average of distances between the surface of the phosphor film and the phosphor-film-side surface of the laminated member BM, as measured perpendicularly to the display surface.

Further, in a case where the phosphor film is fabricated on the rear substrate in a plane approximately parallel with the display surface (the plane will be called the bottom surface of the phosphor film), the BM height hd is a distance between the bottom surface of the phosphor film and the phosphor-film-side surface of the laminated member BM, that is to say, hd is a distance between the phosphor film and the laminated member BM. More generically, the BM height hd is the average of distances between a bottom surface of a discharge space and a discharge-space-side surface of laminated members BM, as measured perpendicularly to a display surface, where a plane containing the laminated members BM is considered, and the bottom surface of the discharge space is defined as a plane which faces the above-mentioned plane across the discharge space and bounds the discharge space.

The reason why the above configuration produces the beneficial effects of the present invention is that a larger amount of the visible light is projected into the visual field space without undergoing further multiple reflections after the visible light is reflected by the light reflection layers of the laminated members BM and then is diffusely reflected by the phosphor film. The following is the reason: The visible light spreads approximately as wide as the distance hd until the visible light reaches the plane containing the laminated members BM (the plane approximately parallel with the display surface) after the visible light is reflected diffusely by the surface of the phosphor film and thereafter propagates in the discharge space. A portion of the spread visible light (a finite amount of the visible light, and in some cases a large amount of the visible light) is emitted into the visual field space through the light-transmissive regions.

In a case where the laminated members BM are employed in the usual structure, the BM height hd is approximately equal to the height hds of the discharge space.

In the case of the PDP employing the structure explained in the "BACKGROUND OF THE INVENTION" section, the height hds of the discharge space is the distance between the surface of the phosphor film and the surface of the front substrate. FIG. 7 depicts the height hds of the discharge space. Usually the height hds of the discharge space is in a range of from 0.1 mm to 0.2 mm. However, the values of the height hds of the discharge space varies with the structures of PDPs to which the present is applied. In the case of PDPs of the vertical-discharge type, or PDPs having an ultra-large viewing screen, for example, the height hds of the discharge space are selected to be larger.

The above condition $0<Lave/hd<1$ is a condition required for obtaining general advantages of the present invention. The condition for heightening the beneficial effects of the present invention based on the above-explained principle of the present invention is $0<Lave/hd<0.5$, and is preferably $0<Lave/hd<0.2$. However, Lave becomes smaller as Lave/hd (>0) is decreased for heightening the beneficial effects further, and consequently, there arises a need for fabricating the laminated members BM of finer structures. That is to say, there arise problems of difficulties in manufacture and an increase in manufacturing cost.

On the other hand, in a case where some limited advantages of the present invention are desired without pursuing the highest performance, some advantages of the present invention can be obtained by the condition $0<Lave/hd<2$, the condition $0<Lave/hd<3$, or the condition $0<Lave/hd<5$, depending upon the desired performance. With these configuration, the value of Lave is made greater, and therefore there is provided an advantage of facilitating the manufacture of the laminated members BM.

Further, the value of Lave capable of being fabricated is usually 0.01 mm or more, and in view of the ease of the manufacture, it is preferable to select the value of Lave to be 0.02 mm or more, 0.05 mm or more, or 0.10 mm or more, depending upon the desired performance. However, the value of Lave may be selected to be 0.01 mm or less, if fabrication techniques are available. In principle, the minimum value of Lave is of the order of wavelengths of visible light, and therefore it is preferable in principle to select the value of Lave to be 0.0005 mm (0.5 nm).

To make the advantages of the present invention pronounced, the higher the reflectance of the phosphor film, the better the performance. The advantages of the present invention is obtained when the reflectance of the phosphor film is 0.5 or more. The advantages of the present invention can be made more pronounced by selecting the reflectance of the phosphor film to be 0.7 or more, 0.9 or more, or 0.95 or more depending upon the desired performance.

What is claimed is:

1. A plasma display panel comprising a plurality of discharge cells disposed between a pair of opposing first and second substrates, each of said plurality of discharge cells comprising at least: at least one pair of electrodes for generating a discharge for display; a discharge gas; and a phosphor film for emitting visible light by being excited by ultraviolet light produced by said discharge of said discharge gas, wherein laminated members are dispersed throughout a plane to form multiple openings between adjacent laminated members in at least one cross-section perpendicular to said first and second substrates within each discharge cell of said plurality of discharge cells inside said first substrate from which visible light for display is emitted, and each of said laminated members comprises a light absorption layer disposed on a side of said first substrate on which ambient light is incident and a light reflection layer disposed on a phosphor-film side of said each of said laminated members.

2. A plasma display panel according to claim 1, wherein said laminated members are integrally fabricated to form a unitary structure in said plane within each of said plurality of discharge cells and said unitary structure perforated with plural openings passing light therethrough in said plane.

3. A plasma display panel according to claim 1, wherein said laminated members are plural in number within each of said discharge cells, and are disposed separately from each other in said plane.

4. A plasma display panel according to claim 1, wherein said laminated members are plural in number within each of said discharge cells, and are disposed separately two-dimensionally from each other in said plane.

5. A plasma display panel according to claim 1, wherein an aperture ratio (S1−S2)/S1 satisfies the following inequality:

$$0.1 \leqq (S1-S2)/S1 \leqq 0.8,$$

where S1 is an area of an opening of one of said discharge cells for emitting said visible light therethrough projected onto said first substrate, and S2 is a sum of areas occupied by said light absorption layers within said area S1.

6. A plasma display panel according to claim 2, wherein said laminated members are fabricated in a pattern of one of a mesh and a ladder.

7. A plasma display panel according to claim 2, wherein said laminated members are provided with openings in a pattern of branches of a tree.

8. A plasma display panel according to claim 3, wherein said laminated members are formed in a pattern of one of (i) isolated islands and (ii) branches of a tree.

9. A plasma display panel according to claim 1, wherein said plasma display panel has at least one cross-section which satisfies the following inequality:

$$0 < La/L \leqq 0.5,$$

where, consider a cross section containing a line contained in a plane of said first substrate and perpendicular to said plane of said first substrate, L is a length of one of said discharge cells as measured in a direction of said line, and La is a minimum value of a length of said laminated members as measured in said direction of said line.

10. A plasma display device including at least a plasma display panel and a driving circuit which applies voltages to said plasma display panel, wherein said plasma display panel comprises a front substrate through which visible light for display is emitted and a plurality of discharge cells;

each of said plurality of discharge cells is provided at least with electrodes for applying voltages to said each of said discharge cells, a discharge gas for generating discharge, a substance which generates visible light based upon said discharge, and laminated members each comprised at least of a light absorption layer and a light reflection layer; and said front substrate defines a part of a discharge space which generates said discharge and forms part of a hermetic sealing, wherein a visual field space is defined as a space on a side of said front substrate opposite from said discharge space, a display surface is defined as a surface obtained by expanding over an entire area of each of said plurality of discharge cells a surface of said front substrate in contact with said discharge space, a portion of said visible light emitted into said visual field space through said display surface serves as said visible light for display, wherein a BM height hd is defined as an average of distances between a bottom surface of said discharge space and discharge-space-side surfaces of said laminated members, as measured perpendicularly to said display surface, where a first plane containing said laminated members is considered, and said bottom surface of said discharge space is a plane which faces said first plane across said discharge space and which bounds said discharge space, wherein said laminated members are disposed one of (i) within said discharge space, (ii) between said discharge space and said front substrate, and (iii) within said front substrate, are each comprised of a light absorption layer disposed on a visual-field-space side thereof and a light reflection layer disposed on a discharge-space side thereof, and wherein the following inequality is satisfied:

$$Lave/hd < 5,$$

where a BM region is defined as a region occupied by said laminated members in said display surface, a light-transmissive region is defined as a region in said display surface through which said visible light from said discharge space is emitted into said visual field space, a length dbm-A is defined as a shortest distance between an arbitrary point A in said BM region and said light-transmissive region, and Lave is a value of said length dbm-A averaged over an entire area of said BM region with respect to said arbitrary point A.

11. A plasma display device according to claim 10, wherein said laminated members are fabricated in a pattern of one of (i) isolated islands, (ii) a mesh, (iii) a ladder, and (iv) branches of a tree.

12. A plasma display device according to claim 10, wherein said laminated members are comprised of electrical insulators.

13. A plasma display device according to claim 10, wherein said laminated members are comprised of electrical conductors.

14. A plasma display device according to claim 10, wherein said laminated members are comprised of a combination of an electrical insulator and an electrical conductor.

15. A plasma display device according to claim 10, wherein said laminated members are electrically insulated from said electrodes for applying voltages to said discharge cells.

16. A plasma display device according to claim 10, wherein a portion of each of said laminated members is electrically connected to a portion of said electrodes for applying voltages to said discharge cells and forms part or an entirety of said electrodes.

17. A plasma display device according to claim 13, wherein said electrodes for applying voltages to said discharge cells form at least part of display electrodes for producing discharge for a display, form at least two kinds of electrodes, X electrodes and Y electrodes, and portions of each of said laminated members form part or an entirety of said X and Y electrodes.

18. A plasma display device according to claim 10, wherein the following inequality is satisfied:

$$Lave/hd<1.$$

19. A plasma display device according to claim 10, wherein said substance which generates visible light is a phosphor film which generates visible light excited by ultraviolet light produced by said discharge, and said BM height hd is an average of distances between a surface of said phosphor film and a phosphor-film-side surface of said laminated members.

20. A plasma display device according to claim 10, wherein said laminated members are disposed on or within said front substrate.

* * * * *